US010609502B2

(12) United States Patent
Zhang et al.

(10) Patent No.: US 10,609,502 B2
(45) Date of Patent: Mar. 31, 2020

(54) METHODS AND SYSTEMS FOR SIMULATING MICROPHONE CAPTURE WITHIN A CAPTURE ZONE OF A REAL-WORLD SCENE

(71) Applicant: Verizon Patent and Licensing Inc., Arlington, VA (US)

(72) Inventors: Zhiguang Eric Zhang, Somerville, NJ (US); Samuel C. Mindlin, Brooklyn, NY (US); Oliver S. Castaneda, Jersey City, NJ (US); Denny Breitenfeld, Florham Park, NJ (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 98 days.

(21) Appl. No.: 15/851,529

(22) Filed: Dec. 21, 2017

(65) Prior Publication Data

US 2019/0200156 A1 Jun. 27, 2019

(51) Int. Cl.

| | |
|---|---|
| ***H04S 7/00*** | (2006.01) |
| ***H04R 1/40*** | (2006.01) |
| ***H04R 29/00*** | (2006.01) |
| ***H04R 3/00*** | (2006.01) |
| ***H04R 5/027*** | (2006.01) |
| ***H04R 3/04*** | (2006.01) |

(52) U.S. Cl.

CPC ..... *H04S 7/303* (2013.01); *H04R 1/406* (2013.01); *H04R 3/005* (2013.01); *H04R 3/04* (2013.01); *H04R 5/027* (2013.01); *H04R 29/005* (2013.01); *H04S 7/305* (2013.01); *H04R 2201/401* (2013.01); *H04R 2227/007* (2013.01); *H04S 2400/15* (2013.01); *H04S 2420/11* (2013.01)

(58) Field of Classification Search

None

See application file for complete search history.

(56) References Cited

U.S. PATENT DOCUMENTS

| | | | | |
|---|---|---|---|---|
| 4,042,779 | A * | 8/1977 | Craven | H04R 5/027 381/103 |
| 2005/0080616 | A1* | 4/2005 | Leung | H04R 5/027 704/200.1 |
| 2009/0046864 | A1* | 2/2009 | Mahabub | H04S 7/30 381/17 |
| 2009/0237564 | A1* | 9/2009 | Kikinis | H04N 13/398 348/584 |

(Continued)

*Primary Examiner* — Antim G Shah

(57) ABSTRACT

An exemplary microphone capture simulation system accesses a captured set of audio signals captured by a plurality of directional microphones disposed at a plurality of locations on a perimeter of a capture zone of a real-world scene. The system identifies a location within the capture zone that corresponds to a virtual location at which a user is virtually located within a virtual reality space that is based on the capture zone. Based on the captured set of audio signals and the identified location, the system generates a simulated set of audio signals representative of a simulation of a full-sphere multi-capsule microphone capture at the identified location. The system processes the simulated set of audio signals to form a renderable set of audio signals configured to be rendered to simulate full-sphere sound for the virtual location while the user is virtually located at the virtual location.

20 Claims, 12 Drawing Sheets

(56) References Cited

U.S. PATENT DOCUMENTS

| | | | | |
|---|---|---|---|---|
| 2009/0316913 | A1* | 12/2009 | McGrath | H04S 3/02 381/20 |
| 2017/0132902 | A1* | 5/2017 | Foster | G01R 21/1333 |
| 2017/0311080 | A1* | 10/2017 | Kolb | H04R 1/342 |
| 2018/0098173 | A1* | 4/2018 | van Brandenburg | G10L 19/008 |

* cited by examiner

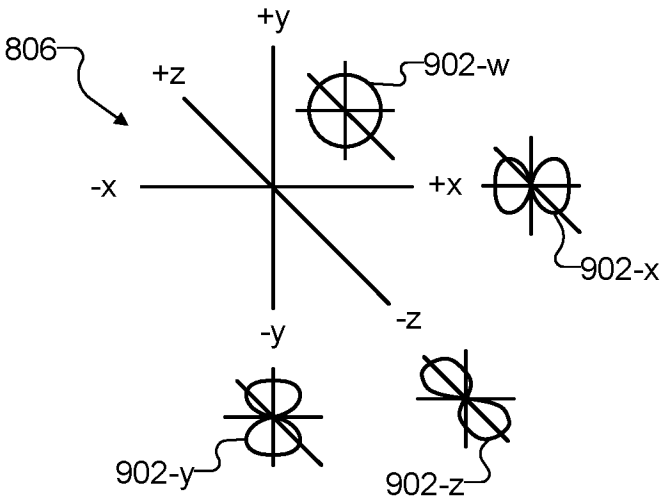
Fig. 9A
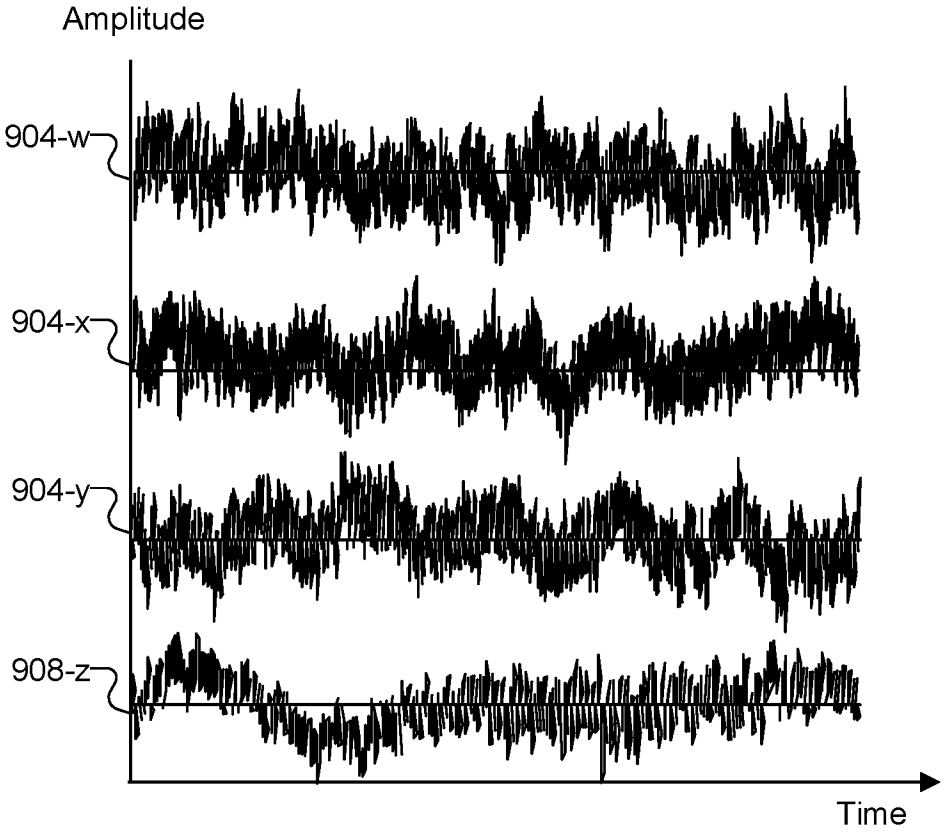
Fig. 9B
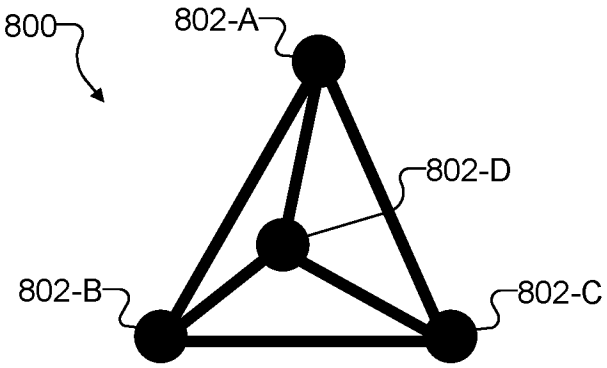

METHODS AND SYSTEMS FOR SIMULATING MICROPHONE CAPTURE WITHIN A CAPTURE ZONE OF A REAL-WORLD SCENE

BACKGROUND INFORMATION

A user of a virtual reality media player device (e.g., a virtual reality headset, a mobile device, a game console, a computer, etc.) may experience virtual reality worlds by way of an immersive rendering, by the media player device, of video the user would see and audio the user would hear if the user were actually present in the virtual reality world. In some examples, such virtual reality worlds may be completely computer-generated (e.g., imaginary worlds, virtualized worlds inspired by real-world places, etc.). In other examples, certain virtual reality worlds experienced by a user may be generated based on camera-captured video of a real-world scene, microphone-captured audio from the real-world scene, and so forth.

To maximize the enjoyment of the user experiencing a particular virtual reality world, it may be desirable for the user to have freedom to move through a virtual reality space within the virtual reality world (e.g., to move to any place the user wishes within the virtual reality space). Providing camera-captured video data and microphone-captured audio data for every location within a virtual reality space based on a real-world scene may present a challenge, however, because cameras and microphones cannot practically be placed at every location with a capture zone of a real-world scene. Currently, audio data provided in connection with such a virtual environment fails to provide some of the immersive qualities of the video data. For example, audio data may not be customized to specific locations within a virtual reality space or may represent sound that does not indicate a direction from which the sound originates to the user. Such deficiencies in the audio data may detract from the immersiveness of the virtual reality world experienced by the user.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

FIGS. 9A and 9B illustrate exemplary aspects of a B-format signal implementation of a renderable set of audio signals configured to be rendered to simulate full-sphere sound for a virtual location according to principles described herein.

DETAILED DESCRIPTION OF PREFERRED EMBODIMENTS

Figure 1:
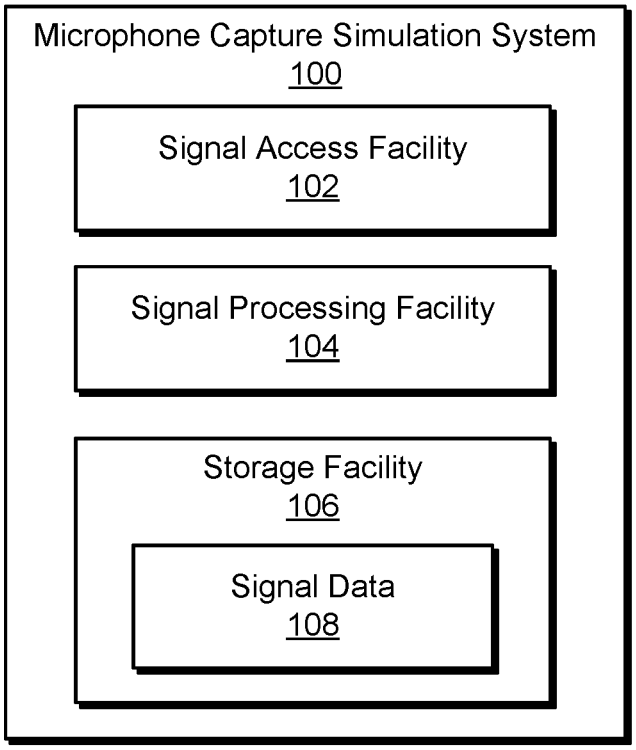
FIG. 1 illustrates an exemplary microphone capture simulation system for simulating microphone capture within a capture zone of a real-world scene according to principles described herein.

Systems and methods for simulating microphone capture within a capture zone of a real-world scene are described herein. For example, as will be described in more detail below, certain implementations of a microphone capture simulation system may access a captured set of audio signals from a plurality of directional microphones disposed at a plurality of locations on a perimeter of a capture zone of a real-world scene. The captured set of audio signals may be captured by the plurality of directional microphones. In some examples, the microphone capture simulation system may access the captured set of audio signals directly (e.g., using a plurality of directional microphones integrated within the microphone capture simulation system), by receiving them from the respective directional microphones that capture the signals, by downloading or otherwise accessing them from a storage facility where the signals are stored, or in any other way as may serve a particular implementation.

The microphone capture simulation system may also identify a particular location within the capture zone. For instance, a user may be experiencing (e.g., using a media player device) a virtual reality space that is based on the capture zone of the real-world scene, and the identified location within the capture zone may correspond to a virtual location at which the user is virtually located within the virtual reality space. In some examples, the microphone capture simulation system may dynamically identify the particular location as the user is experiencing the virtual reality space and the location is continuously changing (e.g., as the user is moving around within the virtual reality space).

Based on the captured set of audio signals that has been accessed and the location that has been identified, the microphone capture simulation system may generate a simulated set of audio signals representative of a simulation of a full-sphere multi-capsule microphone capture at the location. For example, the full-sphere multi-capsule microphone capture represented by the simulated set of audio signals may simulate an A-format signal that would be captured by a multi-capsule microphone (e.g., a full-sphere multi-capsule microphone such as an Ambisonic microphone) if the multi-capsule microphone were located at the identified location.

The microphone capture simulation system may process the simulated set of audio signals to form a renderable set of audio signals. The renderable set of audio signals may be configured to be rendered (e.g., by a media player device used by the user) to simulate full-sphere sound for the virtual location while the user is virtually located at the virtual location within the virtual reality space. For example, the renderable set of audio signals may take the form of a B-format signal (e.g., a filtered and/or decoded B-format signal into which other sounds have optionally been added). When decoded and rendered (e.g., converted for a particular speaker configuration and played back or otherwise presented to a user by way of the particular speaker configuration), a B-format signal may be manipulated so as to replicate not only a sound that has been captured, but also a direction from which the sound originated. In other words, as will be described in more detail below, B-format signals may include sound and directionality information such that they may be rendered to provide full-sphere sound (e.g., three-dimensional ("3D") surround sound) to a listener. In this case, a B-format signal formed by processing the simulated set of audio signals (e.g., the A-format signal) described above may be configured to be rendered as full-sphere sound customized to the virtual location of the user and indicative of respective 3D directions from which different sounds originate.

In the same or other exemplary implementations, a microphone capture simulation system may perform operations for simulating microphone capture within a capture zone of a real-world scene in real time to dynamically and continuously update the microphone capture simulation as a user moves from one point to another within the virtual reality space. As used herein, operations are performed "in real time" when performed immediately and without undue delay. Thus, because operations cannot be performed instantaneously, it will be understood that a certain amount of delay (e.g., from a few milliseconds up to a few seconds) will necessarily accompany any real-time operation. However, if operations are performed immediately such that, for example, an updated microphone capture simulation for a particular location to which a user has moved is provided to the user before the user moves to yet another location (albeit up to a few seconds delayed), such operations will be considered to be performed in real time.

In certain real-time implementations, for example, a microphone capture simulation system may access, in real time from a plurality of directional microphones disposed at a plurality of locations on a perimeter of a capture zone of a real-world scene, a captured set of audio signals captured in real time by the plurality of directional microphones. The microphone capture simulation system may identify, in real time, a first location within the capture zone. The first location may correspond to a first virtual location at which a user is virtually located within a virtual reality space (e.g., a virtual reality space based on the capture zone of the real-world scene) being experienced by the user at a first moment in time. In real time and based on the captured set of audio signals and the first location, the microphone capture simulation system may generate a simulated set of audio signals representative of a simulation of a full-sphere multi-capsule microphone capture at the first location and at the first moment in time.

At a second moment in time subsequent to the first moment in time, the microphone capture simulation system may, in real time, identify a second location within the capture zone. For instance, the second location may correspond to a second virtual location at which the user is virtually located within the virtual reality space at the second moment in time. Based on the captured set of audio signals and the second location, the microphone capture simulation system may update, in real time, the simulated set of audio signals to be representative of a simulation of a full-sphere multi-capsule microphone capture at the second location and at the second moment in time.

As such, the microphone capture simulation system may process, in real time, the simulated set of audio signals to form a renderable set of audio signals. For example, the renderable set of audio signals may be configured to be rendered (e.g., by a media player device used by the user) to simulate full-sphere sound for the first virtual location at the first moment in time and to simulate full-sphere sound for the second virtual location at the second moment in time. Accordingly, as the user moves from one virtual location to another within the virtual reality space (e.g., from the first virtual location to the second virtual location), the microphone capture simulation system may facilitate providing the user with continuously updated audio data representative of full sphere sound for every virtual location to which the user moves.

Methods and systems for simulating microphone capture within a capture zone of a real-world scene may provide various benefits to providers and users of virtual reality content. As described above, virtual reality technology may allow users to look around in any direction (e.g., up, down, left, right, forward, backward) and, in certain examples, to also move around freely to various parts of a virtual reality space. As such, when audio data (e.g., a renderable set of audio signals) generated in accordance with methods and systems described herein is rendered for a user, the audio data may enhance the realism and immersiveness of the virtual reality world as compared to audio data that is not customized to provide full-sphere sound from the user's current virtual location and/or that does not take directionality into account.

Additionally, methods and system described herein may make possible the benefits of full-sphere sound for virtual reality spaces based on real-world scenes (e.g., camera-captured and microphone-captured real-world scenes) without requiring actual multi-capsule microphones (e.g., full-sphere multi-capsule microphones) to be positioned at locations within the capture zone of the real-world scene. Because microphone capture simulations for multi-capsule microphones may be simulated based on captured signals from a plurality of directional microphones disposed on a perimeter of the capture zone, no microphone needs to be disposed within the capture zone at all in some examples. This may be particularly beneficial for capture zones in which it is not possible or convenient to place microphones (e.g., due to potential interference with events happening within the capture zones). For the same reason, there also may not be a need in certain examples for relatively complex multi-capsule microphones (e.g., full-sphere multi-capsule microphones) to be used to capture full-sphere sound for a capture zone. As a result, high quality, full-sphere sound may be provided for real-world-scene-based virtual reality spaces using microphone setups having simpler and fewer microphones disposed at more convenient locations than might be possible using conventional techniques.

Various embodiments will now be described in more detail with reference to the figures. The disclosed systems and methods may provide one or more of the benefits mentioned above and/or various additional and/or alternative benefits that will be made apparent herein.

FIG. 1 illustrates an exemplary microphone capture simulation system 100 ("system 100") for simulating microphone capture within a capture zone of a real-world scene. In particular, as will be described and illustrated in more detail below, system 100 may operate to simulate microphone capture at an arbitrary location within the capture zone when physical microphones may be located only around a perimeter of the capture zone or, in any case, may not be located at the arbitrary location for which the microphone capture is simulated. As shown, system 100 may include, without limitation, a signal access facility 102, a signal processing facility 104, and a storage facility 106 selectively and communicatively coupled to one another. It will be recognized that although facilities 102 through 106 are shown to be separate facilities in FIG. 1, facilities 102 through 106 may be combined into fewer facilities, such as into a single facility, or divided into more facilities as may serve a particular implementation. Each of facilities 102 through 106 may be distributed between multiple devices (e.g., server-side devices and/or client-side devices) and/or multiple locations as may serve a particular implementation. Additionally, one or more of facilities 102 through 106 may be omitted from system 100 in certain implementations, while additional facilities may be included within system 100 in the same or other implementations. Each of facilities 102 through 106 will now be described in more detail.

Signal access facility 102 may include any hardware and/or software (e.g., including microphones, audio interfaces, network interfaces, computing devices, software running on or implementing any of these devices or interfaces, etc.) that may be configured to capture, receive, download, and/or otherwise access audio signals for processing by signal processing facility 104. For example, signal access facility 102 may access a captured set of audio signals captured by a plurality of directional microphones disposed at a plurality of locations on a perimeter of a capture zone of a real-world scene (e.g., cardioid microphones or the like whose directional polar pattern is pointed inward toward the capture zone, as will be illustrated below).

Signal access facility 102 may access the captured set of audio signals from the plurality of directional microphones in any suitable manner. For instance, in certain implementations, signal access facility 102 may include one or more directional microphones such that accessing the captured set of audio signals from these microphones may be performed by using these integrated directional microphones to directly capture the signals. In the same or other implementations, some or all of the audio signals accessed by signal access facility 102 may be captured by directional microphones that are external to system 100 and under the direction of signal access facility 102 or of another system. For instance, signal access facility may receive audio signals directly from directional microphones external to, but communicatively coupled with, system 100, and/or from another system, device, or storage facility that is coupled with the microphones and provides the audio signals to system 100 in real time or after the audio signals have been recorded, preprocessed, and/or stored. Regardless of how system 100 is configured with respect to the plurality of directional microphones and/or any other external equipment, systems, or storage used in the audio signal capture process, as used herein, system 100 may be said to access an audio signal from the plurality of directional microphones if system 100 has gained access to audio signals that the plurality of directional microphones captured.

Signal processing facility 104 may include one or more physical computing devices (e.g., the same hardware and/or software components included within signal access facility 102 and/or components separate from those of signal access facility 102) that perform various signal processing operations for simulating microphone capture within a capture zone of a real-world scene. For example, signal processing facility 104 may perform operations associated with identifying a location within the capture zone of the real-world scene, generating a simulated set of audio signals associated with the identified location, and/or processing the simulated set of audio signals to form a renderable set of audio signals for rendering by a media player device.

More specifically, signal processing facility 104 may be configured to identify (e.g., dynamically identify while a user is experiencing and moving around within a virtual reality space) a location within the capture zone that corresponds to a virtual location at which a user is virtually located within a virtual reality space being experienced by the user. For example, if the virtual reality space is based on the capture zone of the real-world scene, the identified location in the capture zone may be the location that corresponds to the current virtual location of the user in the virtual reality space. As such, signal processing facility 104 may include or have access to a communication interface by way of which the current virtual location of the user (e.g., which may be tracked by a media player device the user is using to experience the virtual reality space) may be received from the media player device being used by the user. In some examples, signal processing facility 104 may continuously receive updated information regarding the virtual location as the user experiences the virtual reality space and the media player device tracks the changing virtual location of the user within the virtual reality space.

Signal processing facility 104 may further be configured to generate a simulated set of audio signals representative of a simulation of the audio signals that a full-sphere multi-capsule microphone (e.g., an Ambisonic microphone such as a SOUNDFIELD microphone or another microphone capable of capturing 3D surround sound using multiple microphone capsules) would capture at the identified location. The simulated set of audio signals may be generated based on the captured set of audio signals and the identified location in any suitable way, as will be described in more detail below. Once the simulated set of audio signals is generated, signal processing facility 104 may also process the simulated set of audio signals in various ways that will also be described in more detail below. For example, signal processing facility 104 may process the simulated set of audio signals to form a renderable set of audio signals configured to be rendered (e.g., by the media player device used by the user) to simulate full-sphere sound for the virtual location while the user is virtually located at the virtual location within the virtual reality space.

As described previously, in certain examples, the operations performed by signal access facility 102 and signal processing facility 104 may each be performed in real time as the user is experiencing the virtual reality space to allow the user to continuously enjoy full-sphere surround sound customized to his or her current virtual location within the virtual reality space.

Storage facility 106 may include signal data 108 and/or any other data received, generated, managed, maintained, used, and/or transmitted by facilities 102 and 104. Signal data 108 may include data associated with the audio signals such as the captured set of audio signals accessed by signal access facility 102, the simulated set of audio signals generated by signal processing facility 104, the renderable set of audio signals formed based on the simulated set of audio signals, and/or any other signals (e.g., intermediary signals) or data used to implement methods and systems described herein as may serve a particular implementation.

Figure 2:
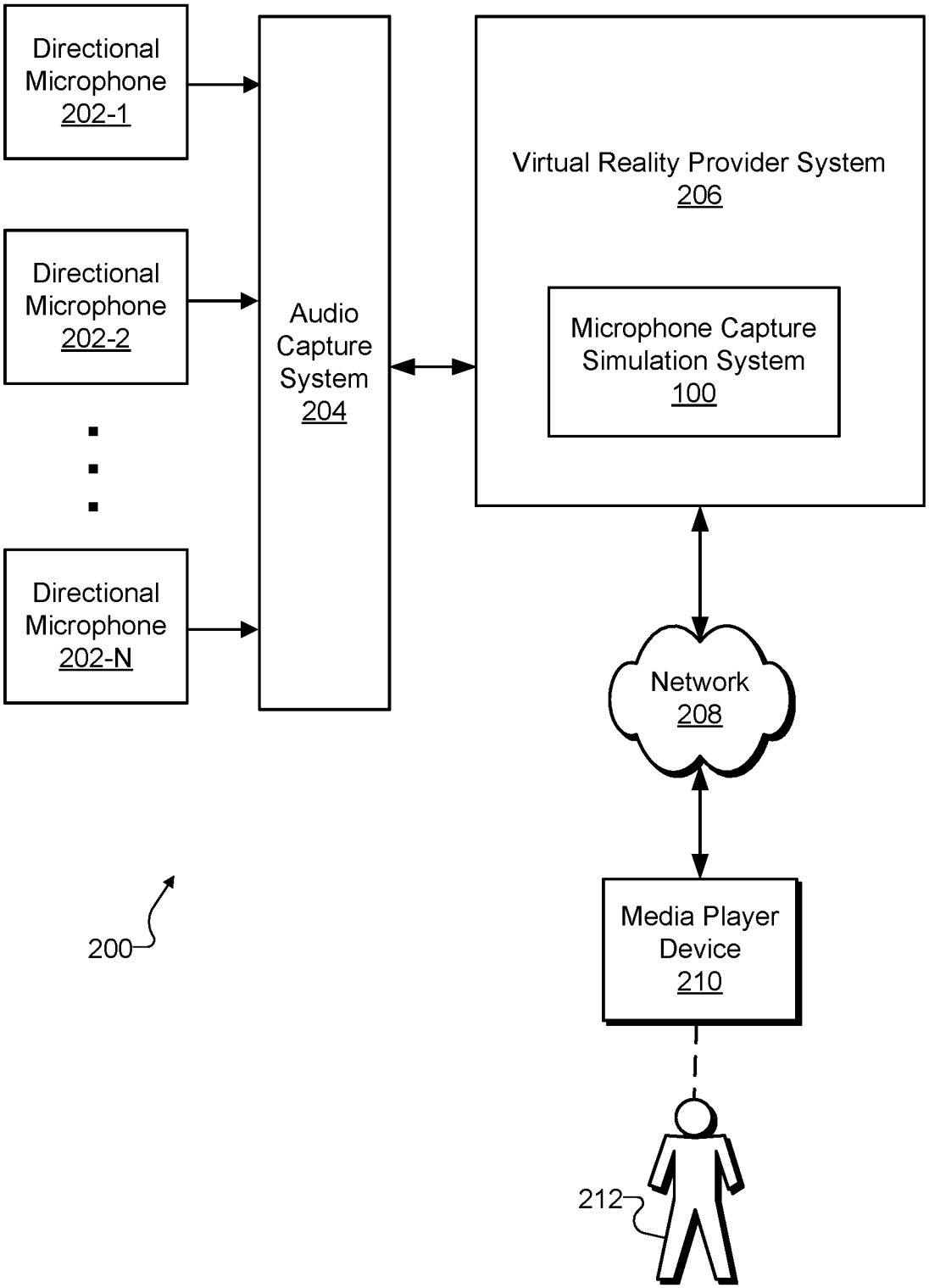
FIG. 2 illustrates an exemplary configuration in which the microphone capture simulation system of FIG. 1 may operate according to principles described herein.

To illustrate system 100 in operation, FIG. 2 shows an exemplary configuration 200 in which system 100 may operate. As shown in FIG. 2, a plurality of directional microphones 202 (e.g., microphones 202-1 through 202-N) may provide respective captured audio signals to an audio capture system 204. For example, directional microphones 202 may be disposed at various locations within a real-world scene (e.g., locations outlining a perimeter of a particular capture zone) and may feed into an audio interface (e.g., associated with mixing, pre-processing, equalization, analog-to-digital conversion, recording, etc.) that implements audio capture system 204. As mentioned above, in some examples, directional microphones 202 and audio capture system 204 may be integrated within system 100 (e.g., within signal access facility 102), while in other examples such as illustrated in FIG. 2, these components may be separate from and accessed by system 100.

As further illustrated by configuration 200, system 100 may be included within a virtual reality provider system 206 that is communicatively coupled with audio capture system 204 as well as with a network 208. Virtual reality provider system 206 (and system 100, as a subsystem thereof) may exchange and communicate data, by way of network 208, with a media player device 210 associated with a user 212.

Virtual reality provider system 206 may be responsible for capturing, accessing, generating, distributing, and/or otherwise providing and curating virtual reality media content for one or more media player devices such as media player device 210. As such, virtual reality provider system 206 may capture virtual reality data representative of image data (e.g., video) and audio data (e.g., a renderable set of audio signals simulating full-sphere sound for a particular virtual location), and may combine this data into a form that may be distributed and used by media player devices such as media player device 210 to provide virtual reality experiences for users such as user 212.

Virtual reality data may be distributed using any suitable communication technologies included in network 208, which may include a provider-specific wired or wireless network (e.g., a cable or satellite carrier network or a mobile telephone network), the Internet, a wide area network, a content delivery network, and/or any other suitable network or networks. Data may flow between virtual reality provider system 206 and one or more media player devices such as media player device 210 using any communication technologies, devices, media, and protocols as may serve a particular implementation.

Figure 3:
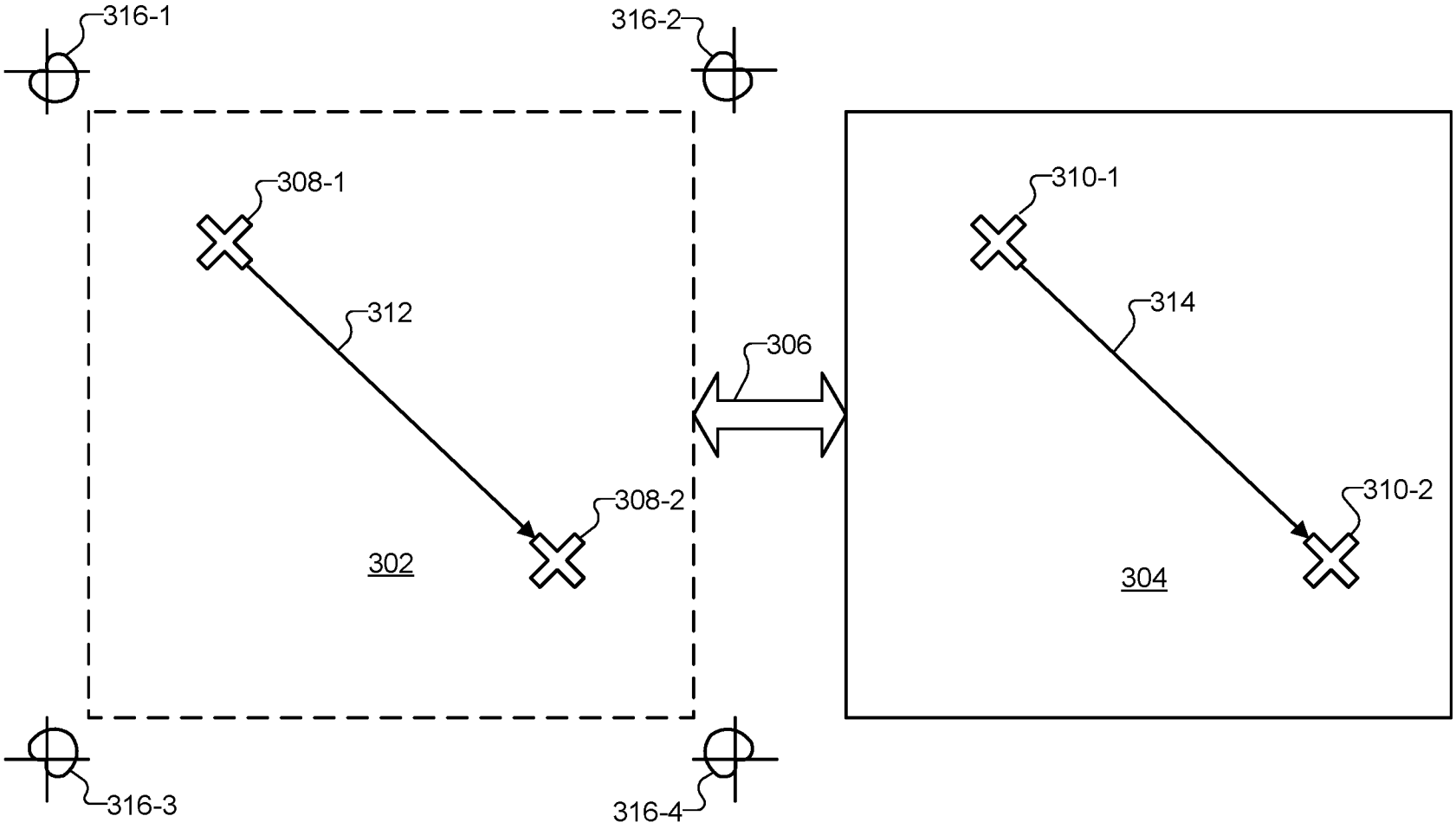
FIG. 3 illustrates an exemplary capture zone of a real-world scene and an exemplary virtual reality space based on the capture zone according to principles described herein.

As described above, system 100 may operate within a configuration such as configuration 200 to simulate microphone capture for arbitrary locations (e.g., locations where no physical microphone is disposed) within a capture zone of a real-world scene. To illustrate the relationship between these virtual locations and this capture zone of this real-world scene, FIG. 3 illustrates an exemplary capture zone 302 of a real-world scene and a corresponding exemplary virtual reality space 304 based on capture zone 302. While capture zone 302 represents a real-world physical space (e.g., a physical stage on which a concert is being performed, a particular portion of a playing field upon which a sport is being played, etc.) and virtual reality space 304 represents a 3D space that is virtual only, an arrow 306 indicates a correspondence between capture zone 302 and virtual reality space 304. In other words, as indicated by arrow 306, capture zone 302 in the real world corresponds to virtual reality space 304 in the virtual realm. As such, various arbitrary locations 308 (e.g., such as locations 308-1 and 308-2) within capture zone 302 may correspond to various virtual locations 310 (e.g., such as virtual locations 310-1 and 310-2). Similarly, a path 312 from one location 308-1 to another location 308-2 in the real world may correspond to a path 314 from one virtual location 310-1 to another virtual location 310-2 that a user may virtually traverse within virtual reality space 304.

Capture zone 302 may be included (e.g., along with other capture zones adjacent to or separate from capture zone 302) within a real-world scene. As such, capture zone 302 may be associated with any real-world scenery, real-world location, real-world event (e.g., live event, etc.), or other subject existing in the real world (e.g., as opposed to existing only in a virtual world) and that may be captured by various type of capture devices (e.g., color video cameras, depth capture devices, microphones, etc.) to be replicated in virtual reality content. Capture zone 302 may refer to a particular area within a real-world scene defined by placement of capture devices being used to capture visual and/or audio data of the real-world scene. For example, if a real-world scene is associated with a basketball venue such as a professional basketball stadium where a professional basketball game is taking place, capture zone 302 may be the actual basketball court where the players are playing or a portion of the basketball court defined by a plurality of microphones or other capture devices.

To capture sound within capture zone 302, FIG. 3 shows polar pattern symbols representative of a plurality of directional microphones 316 (e.g., microphones 316-1 through 316-4) disposed at a plurality of locations on a perimeter of capture zone 302. Directional microphones 316 may implement directional microphones 202, described above. As such, audio signals captured by each of microphones 316 may be captured directly by system 100 or by an audio capture such as audio capture system 204 described above (not explicitly illustrated).

As shown, directional microphones 316 are disposed at each corner of capture zone 302, which is depicted as a quadrilateral shape (e.g., a square or a rectangle). In the example of FIG. 3, each of microphones 316 may be a directional microphone (i.e., a microphone configured to capture sound originating from certain directions better than sound originating from other directions) oriented or pointed generally toward the center of capture zone 302. For this reason, microphones 316 are represented in FIG. 3 by small symbols illustrating directional polar patterns (i.e., a cardioid shape drawn on top of coordinate axes indicating that capture sensitivity is greater for sound originating from the direction of capture zone 302 than for sound originating from other directions). While cardioid polar patterns are illustrated in FIG. 3, it will be understood that any suitable directional polar patterns (e.g., cardioid, supercardioid, hypercardioid, subcardioid, figure-8, etc.) may be used as may serve a particular implementation.

In certain examples, each microphone 316 may be a single-capsule microphone including only a single capsule for capturing a single (i.e., monophonic) audio signal. In other examples, one or more of microphones 316 may include multiple capsules used to capture directional signals (e.g., using beamforming techniques or the like). However, even if none of microphones 316 are implemented as a full-sphere multi-capsule microphone such as an Ambisonic microphone or the like, the captured set of audio signals captured by microphones 316 may be used to generate a simulated set of audio signals representative of a microphone capture of a full-sphere multi-capsule microphone disposed at a particular location within capture zone 302.

In certain examples, each directional microphone 316 may be implemented by a discrete physical microphone. In other examples, however, exclusive use of discrete physical microphones to implement each directional microphone 316 may be impractical or undesirable. For instance, if capture zone 302 is implemented as a relatively large physical space such as, for example, an entire football field, a directional microphone 316 disposed at one corner of capture zone 302 (e.g., microphone 316-1) may not be well-equipped to capture sound originating near other corners of capture zone 302 (e.g., such as the opposite corner near microphone 316-4). In such examples, or other examples in which discrete physical microphones may not be well equipped to capture sound in at least certain areas of capture zone 302, one or more of directional microphones 316 may be implemented as a uniform linear array ("ULA") microphone.

As used herein, a "ULA microphone" may refer to a virtual microphone that is composed of a plurality of microphones disposed at different locations (i.e., as opposed to a physical microphone disposed at one particular location) that are combined and processed together to form audio signals not captured by any particular physical microphone in the uniform linear array. For example, respective audio signals from the plurality of microphones composing a ULA microphone may be processed together so as to generate a single audio signal (e.g., a directional audio signal) representative of what the ULA microphone captures. In some examples, a plurality of microphones composing a ULA microphone implementing one of directional microphones 316 may include a plurality of omnidirectional microphones disposed at different locations with respect to capture zone 302. Even though each of these omnidirectional microphones may capture an omnidirectional audio signal, when processed together in a suitable way (e.g., using beamforming techniques), these omnidirectional signals may be used to generate a directional signal to be used in the captured set of audio signals captured by directional microphones 316.

In some examples, audio signals captured by particular physical microphones may be employed as audio signals in their own right, as well as combined with other audio signals to generate ULA audio signals. For example, an audio signal captured by microphone 316-1 may be included in a captured set of audio signals provided to system 100 while also contributing (e.g., along with audio signals captured by microphones 316-2 and 316-3) to a ULA audio signal for directional microphone 316-4, which may be implemented, at least for certain sounds near directional microphone 316-1, as a ULA microphone that is composed of the three discrete physical microphones implementing directional microphones 316-1 through 316-3.

By implementing one or more of directional microphones 316 as ULA microphones, it may be possible for a virtual reality media provider to scale capture zone 302 to be a larger size than might be practically possible relying on only discrete physical microphones. For instance, in some examples, a real-world scene of a relatively large size (e.g., the size of a city) and that includes one or more capture zones such as capture zone 302 may be served by a large array of microphones distributed in various locations within the real-world scene. This array of microphones may be combined in different ways to form different ULA microphones as may serve a particular implementation.

As illustrated in FIG. 3, in some examples, a capture zone such as capture zone 302 may be served by four directional microphones (e.g., directional microphones 316-1 through 316-4), which may be placed at corners of the capture zone. This four-microphone configuration may be sufficient to simulate a full-sphere multi-capsule microphone capture for a first-order Ambisonic microphone. For example, each of directional microphones may be oriented (e.g., pointed) in different directions and fixed in different locations and/or at different heights to suitably capture sound from directions along each 3D axis within capture zone 302. For instance, directional microphones 316-1 and 316-4 may be fixed at their respective corners of capture zone 302 at one particular height while directional microphones 316-2 and 316-3 may be fixed at their respective corners of capture zone 302 at a different particular height (e.g., a height lower to the ground). Because capture zone 302 is depicted in FIG. 3 from a top view, differing heights of directional microphones 316 are not explicitly illustrated.

While FIG. 3 shows a first-order, four-microphone example, it will be understood that, in other implementations, higher orders of full-sphere multi-capsule microphones (e.g., higher order Ambisonic microphones) may be employed. Such implementations may involve larger numbers of directional microphones 316 or omnidirectional microphones analogous to microphones 316 in more complex arrangements. While these higher order arrangements may add a degree of complexity to the capture setup of capture zone 302, various advantages related to capture quality, directional integrity and resolution, and sound realism may be provided by these arrangements in certain examples.

As described above, system 100 may provide various benefits by performing various operations from within a configuration (e.g., configuration 200) to simulate full-sphere microphone capture for one or more arbitrary locations within a capture zone of a real-world scene (e.g., locations 308 within capture zone 302). Examples of some of these operations that system 100 may perform will now be described in more detail.

Figure 4:
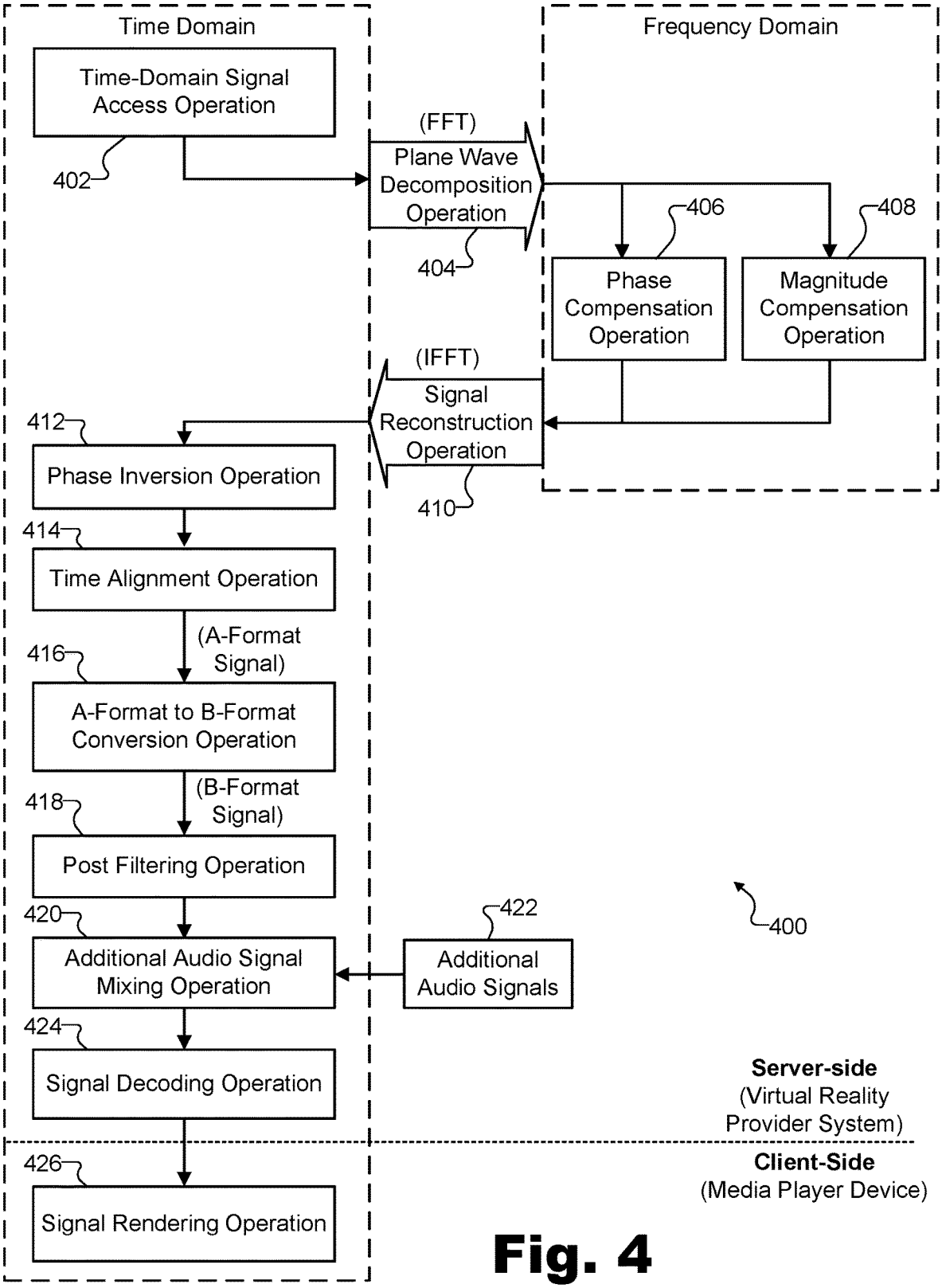
FIG. 4 illustrates an exemplary dataflow for generating and using a simulated microphone capture for an arbitrary location within a capture zone of a real-world scene according to principles described herein.

FIG. 4 illustrates an exemplary dataflow 400 for generating and using a simulated microphone capture for an arbitrary location within a capture zone of a real-world scene. As shown, dataflow 400 includes a time-domain signal access operation 402, a plane wave decomposition operation 404, a phase compensation operation 406, a magnitude compensation operation 408, a signal reconstruction operation 410, a phase inversion operation 412, a time alignment operation 414, an A-format to B-format conversion operation 416, a post filtering operation 418, an additional audio signal mixing operation 420 involving additional audio signals 422, a signal decoding operation 424, and a signal rendering operation 426.

While FIG. 4 illustrates exemplary operations according to one embodiment, other embodiments may omit, add to, reorder, and/or modify any of the operations shown in FIG. 4. One or more of the operations shown in FIG. 4 may be performed by system 100, any components included therein, and/or any implementation thereof. For example, signal access facility 102 within system 100 may perform time-domain signal access operation 402 as part of the accessing of the captured set of audio signals performed by that facility. Similarly, the generating of the simulated set of audio signals representative of the simulation of the full-sphere multi-capsule microphone capture performed by signal processing facility 104 may include performing, for each audio signal in the captured set of audio signals, one or more of plane wave decomposition operation 404, phase compensation operation 406, magnitude compensation operation 408, signal reconstruction operation 410, and phase inversion operation 412. The processing of the simulated set of audio signals to form the renderable set of audio signals also performed by signal processing facility 104 may then including performing one or more of time alignment operation 414, A-format to B-format conversion operation 416, post filtering operation 418, additional audio signal mixing operation 420, and signal decoding operation 424. Finally, a media player device associated with system 100 (e.g., partially implementing system 100, communicatively coupled with system 100, etc.) may perform signal rendering operation 426 to use the simulated microphone capture generated by system 100.

As illustrated, certain operations depicted in dataflow 400 may be performed in the time domain (e.g., performed using signals represented as varying amplitudes with respect to time). Other operations may be performed in the frequency domain (e.g., performed using signals represented as varying magnitudes and phases with respective to different frequency ranges). Still other operations may be performed to transform or convert signals between the time domain and the frequency domain. While operations in FIG. 4 may be shown to be performed within a specific one of the time domain and the frequency domain, it will be understood that, in certain implementations, certain operations or aspects thereof may be performed in an opposite or different domain as the one illustrated.

In like manner, dataflow 400 illustrates a line between operations performed on a server-side (e.g., a provider side of a distribution network such as network 208) by system 100 or another component of a virtual reality provider system such as virtual reality provider system 206, and operations performed on a client-side (e.g., a user side of the distribution network) by a media player device such as media player device 210. In the example of FIG. 4, operations 402 through 424 are all performed on the server-side while only operation 426 is performed on the client-side. However, it will be understood that, in other examples, certain operations or aspects thereof may be performed on whichever side of the network may serve a particular implementation. For instance, in one example, operations 404 through 414 related to generating an A-format signal may be performed on the server-side while operations 416 through 426 related to processing the simulated A-format signal to form a renderable B-format signal may be performed on the client-side. In another example, operations 404 through 416 related to generating the A-format signal and processing it to form a B-format signal may be performed on the server-side while operations 418 through 426 related to post-processing and rendering the B-format signal may be performed on the client-side.

Each of operations 402 through 426 will now be described in more detail with reference to FIG. 4, as well as with reference to FIGS. 5 through 9B below, as indicated.

Time-domain signal access operation 402 may include capturing data or otherwise accessing captured data representative of a captured set of audio signals. The captured set of audio signals may each be captured in the time domain and may be analog or digital signals as may serve a particular implementation. Accessing the captured set of audio signals for time-domain signal access operation 402 may be performed in any of the ways described herein.

Plane wave decomposition operation 404 may include any form of plane wave decomposition of the captured set of audio signals as may serve a particular implementation. While sound captured within a capture zone may not literally constitute ideal plane waves, it may be convenient mathematically to apply signal processing to audio signals that have been decomposed into estimated plane wave constituents. In other words, rather than performing signal processing on the captured set of audio signals in the time domain, it may be mathematically convenient to perform the signal processing in the frequency domain. To this end, plane wave decomposition operation 404 may include transforming each of the audio signals in the captured set of audio signals into a respective frequency-domain audio signal by way of a suitable frequency-domain transform technique such as a fast Fourier transform ("FFT") technique or the like. Once converted, plane wave decomposition operation 404 may further involve converting complex values included within each of the respective frequency-domain audio signals from a Cartesian form to a polar form. In polar form, magnitudes of each complex value may represent a magnitude of a particular frequency component (e.g., a particular plane wave constituent of the audio signal) while angles of each value may represent a phase of the particular frequency component.

Figure 5:
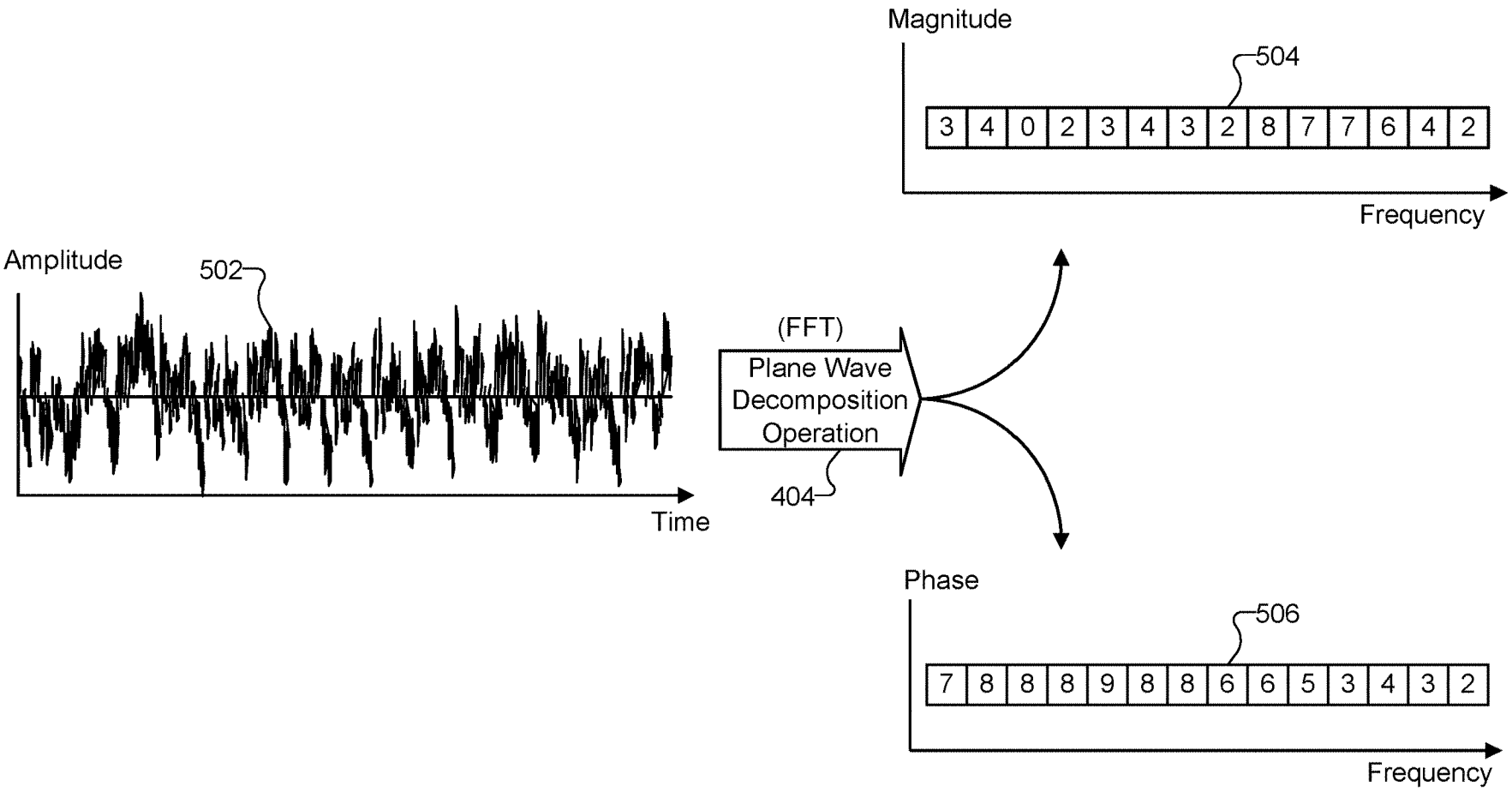
FIG. 5 illustrates exemplary aspects of the plane wave decomposition operation of FIG. 4 according to principles described herein.

To illustrate, FIG. 5 depicts exemplary aspects of plane wave decomposition operation 404. As shown, a particular time-domain audio signal 502 may be converted, by way of plane wave decomposition operation 404, into a polar-form frequency-domain audio signal having both a magnitude component 504 and a phase component 506. Time-domain audio signal 502 may represent a particular audio signal in the captured set of audio signals accessed by time-domain signal access operation 402. As such, it will be understood that plane wave decomposition operation 404 may operate on each of the plurality of audio signals in the captured set of audio signals to generate a plurality of respective polar-form frequency-domain audio signals similar to the one shown in FIG. 5.

Magnitude component 504 includes values representative of respective plane wave magnitudes at each frequency in a number of discrete frequencies or frequency ranges (also referred to as "frequency bins") provided by the frequency-domain transform technique (e.g., the FFT technique). Similarly, phase component 506 includes values representative of respective plane wave phases at each frequency in the frequencies provided by the frequency-domain transform technique. For example, as shown, a lowest frequency bin provided by the frequency-domain transform technique may represent a plane wave having a magnitude of "3" and a phase of "7," a second lowest frequency bin may represent a plane wave having a magnitude of "4" and a phase of "8," and so forth. It will be understood that the single digit values illustrated in FIG. 5 to represent magnitude and phase values are random digits for illustration purposes and may not correspond to any particular units or any particular audio signal.

System 100 may perform plane wave decomposition operation 404 to generate magnitude component 504 and phase component 506 of the polar-form frequency-domain audio signal in any suitable way. For example, system 100 may employ an overlap-add technique to facilitate real-time conversion of audio signals from the time domain to the frequency domain. The overlap-add technique may be performed by system 100 prior to the frequency-domain transform technique to avoid introducing undesirable clicking or other artifacts into a final renderable set of audio signals that is to be generated and provided to the media player device for playback to the user.

Returning to FIG. 4, phase compensation operation 406 may be performed in the frequency domain using the polar-form frequency-domain audio signal generated by plane wave decomposition operation 404. In particular, phase compensation operation 406 may adjust phase values in phase component 506 of the frequency-domain audio signal to simulate the phase values that would be captured by a microphone at a particular identified location (e.g., an arbitrary location within a capture zone where no actual microphone is disposed).

Specifically, after system 100 generates a set of frequency-domain audio signals (e.g., such as the one illustrated in FIG. 5) as a result of performing plane wave decomposition operation 404, phase compensation operation 406 may be performed with respect to the set of frequency-domain audio signals that has been generated. Phase compensation operation 406 may include determining, for each frequency (e.g., each frequency bin provided by the frequency-domain transform technique) represented in each of the frequency-domain audio signals in the set of frequency-domain audio signals, a projected phase associated with the identified location. For example, the projected phase may be determined based on a measured phase for the frequency represented in the frequency-domain audio signal, as will now be described and illustrated.

Figure 6B:
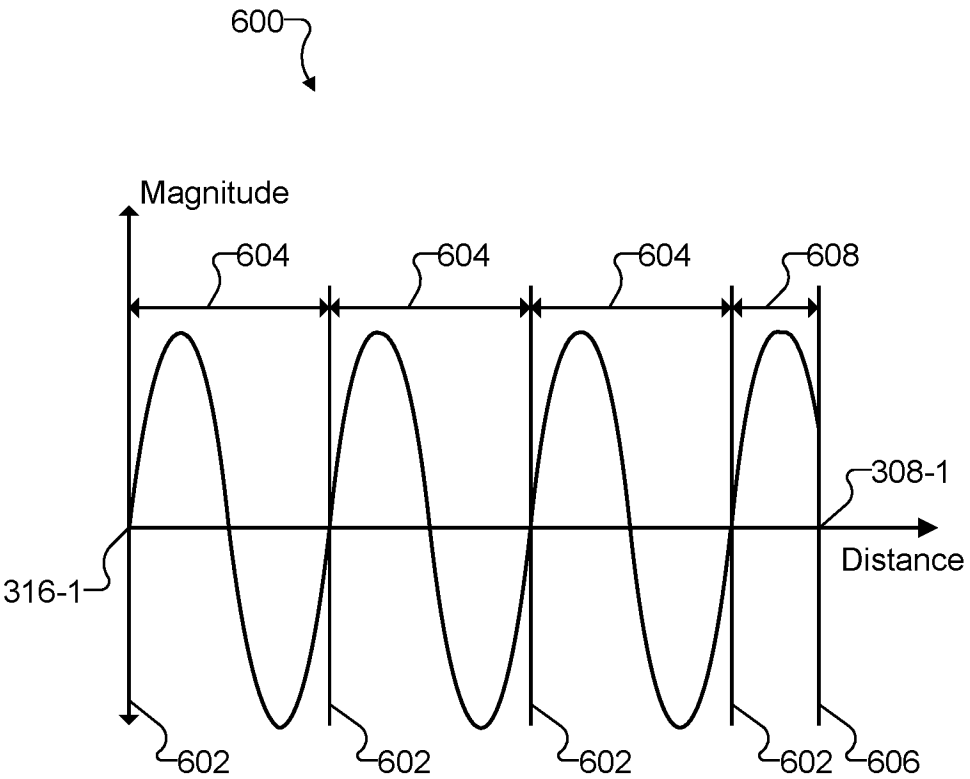
FIGS. 6A and 6B illustrate exemplary aspects of the phase compensation operation of FIG. 4 according to principles described herein.
Figure 6A:
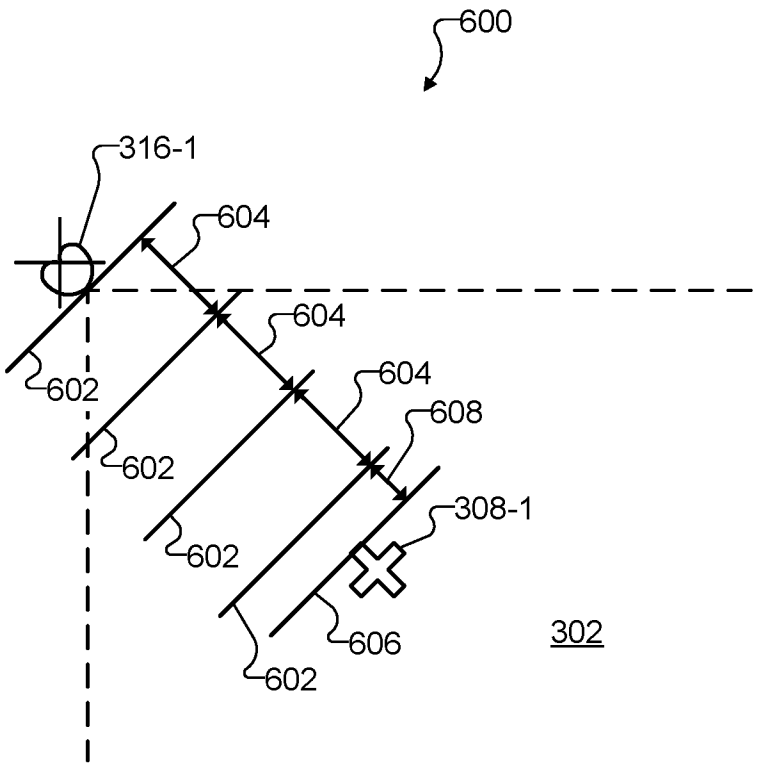

FIGS. 6A and 6B illustrate exemplary aspects of phase compensation operation 406. Specifically, FIGS. 6A and 6B respectively illustrate a physical view and a waveform graph of a particular plane wave 600. For example, plane wave 600 may be a sinusoidal component (e.g., associated with a particular frequency bin) of a frequency-domain audio signal generated by plane wave decomposition operation 404 based on a time-domain audio signal captured by a particular directional microphone. More particularly, in this example, directional microphone 316-1 may capture an audio signal (i.e., in the time domain) from capture zone 302, and system 100 may perform plane wave decomposition operation 404 on the time-domain audio signal to determine respective magnitudes and phases for a plurality of constituent plane waves making up the audio signal. As described above, each of these plane waves may be associated with a different frequency range or frequency bin. Plane wave 600 is one example of a plane wave included within the audio signal, but it will be understood that a plurality of other plane waves associated with other frequency bins also included within the captured audio signal may be processed in a similar way as will be described for plane wave 600.

In the example illustrated in FIGS. 6A and 6B, phase compensation operation 406 is determining, for the particular frequency represented by plane wave 600, a projected (e.g., simulated, estimated, etc.) phase associated with location 308-1. In particular, the projected phase associated with location 308-1 may provide an accurate simulation of the phase when location 308-1, representing the user location (i.e., the listener), is in the near field (e.g., within approximately 1 meter in some examples) with respect to one or more locations of one or more sound sources that generate sound being captured by microphone 316-1 (not explicitly illustrated). It will be understood that, in other examples, the same principles described herein may be applied to determine a projected phase associated with location 308-2 and/or any other arbitrary location included within capture zone 302. As shown in FIGS. 6A and 6B, plane wave 600 periodically oscillates through cycles that each begin at a particular phase 602 and that are each characterized by a wavelength 604. For example, because plane wave 600 may propagate at a relatively constant speed through the air (i.e., the speed of sound, or approximately 343 m/s), wavelength 604 may be calculated by dividing the speed of sound by the frequency of plane wave 600.

As shown, the distance between microphone 316-1 and location 308-1 may not happen to be an exact multiple of wavelengths 604. As a result, sounds arriving at microphone 316-1 with phase 602 may be expected to arrive at location 308-1 with a different phase such as a projected phase 606.

It will be understood that projected phase 606 may represent an estimation of a phase to be expected at location 308-1 because the geometry of the sound source with respect to microphone 316-1 and location 308-1 may also need to be taken into account to determine an exact phase to be expected at location 308-1 based on the phase measured at microphone 316-1. For instance, as mentioned above, in examples where location 308-1 is in the near field with respect to one or more sound sources generating the sounds from which plane wave 600 originates, projected phase 606 may be an accurate estimation of the phase to be expected at location 308-1. As such, the detail of where the sound sources are located may be ignored and projected phase 606 may be used to accurately simulate the phase that would be captured at location 308-1.

However, in other examples such as where location 308-1 is in the far field with respect to the one or more sound sources, it may be desirable to take the location of the one or more sound sources into account to improve the projected phase approximation for location 308-1. For example, along with identifying the location corresponding to the virtual location at which the user is virtually located, system 100 may further identify within the capture zone one or more locations of one or more sound sources at which sound represented within the captured set of audio signals originates. Accordingly, the generating of the simulated set of audio signals representative of the simulation of the full-sphere multi-capsule microphone capture may be further based on the identified one or more locations of the one or more sound sources. The identified one or more locations of the one or more sound sources may be used to generate the simulated set of audio signals in any suitable manner. In some examples, the projected phase approximation may be improved iteratively in situations where multiple sound sources exist at different locations.

Regardless of whether one or more positions of the one or more sound sources are taken into account, projected phase 606 may be determined and simulated based on wavelength 604 and based on the distance between microphone 316-1 and location 308-1, as shown. System 100 may determine and track the distance between the location of the user (e.g., location 308-1 in this example) and each directional microphone in the plurality of directional microphones (e.g., including microphone 316-1 in this example) in any manner as may serve a particular implementation. For example, a known distance from a virtual location of the user (e.g., virtual location 310-1) to a particular corner of virtual reality space 304 in the virtual realm may have a known constant relationship with an actual distance between a corresponding location (e.g., location 308-1) and a corresponding corner of capture zone 302 (e.g., where microphone 316-1 is located).

Thus, once the distance between microphone 316-1 and location 308-1 and wavelength 604 have been determined, a phase shift between phase 602 and phase 606 may be calculated as a wavelength-normalized product of $2\pi$ and a length 608 defined as the remainder of the distance divided by wavelength 604 (i.e., determined by performing a modulo operation ("%") on the distance and the wavelength). In other words, if the distance between microphone 316-1 and location 308-1 is represented by "d" and wavelength 604 is represented by "λ", a phase shift "Δθ" between phase 602 and phase 606 may be represented mathematically by Equation 1:

$$\Delta\theta = 2\pi \frac{d \% \lambda}{\lambda} \quad \text{(Equation 1)}$$

Accordingly, phase compensation operation 406 may determine projected phase 606 associated with location 308-1 by subtracting phase 602 from the phase shift (Δθ) calculated using Equation 1. As described above, phase compensation operation 406 may involve performing this calculation for each frequency bin included in each frequency-domain audio signal.

Returning to FIG. 4, magnitude compensation operation 408 may be performed in the frequency domain similar to phase compensation operation 406. In some examples, magnitude compensation operation 408 may be performed in parallel with phase compensation operation 406. Just as phase compensation operation 406 compensates for phase component 506 of each frequency-domain audio signal based on a distance from each respective microphone to the identified arbitrary location within the capture zone, magnitude compensation operation 408 compensates for magnitude component 504 of each frequency-domain audio signal in a similar way. In other words, magnitude compensation operation 408 may adjust magnitude values in magnitude component 504 of each frequency-domain audio signal to simulate the magnitude values that would be captured by a microphone at the identified location within the capture zone where no actual microphone is disposed (e.g., location 308-1 of capture zone 302).

Specifically, after system 100 generates the set of frequency-domain audio signals (e.g., such as the one illustrated in FIG. 5) as a result of performing plane wave decomposition operation 404, magnitude compensation operation 408 may be performed with respect to the set of frequency-domain audio signals that has been generated. Magnitude compensation operation 408 may include determining, for each frequency (e.g., each frequency bin provided by the frequency-domain transform technique) represented in each of the frequency-domain audio signals in the set of frequency-domain audio signals, a projected magnitude associated with the identified location. For example, the projected magnitude may be determined based on a measured magnitude for the frequency represented in the frequency-domain audio signal, as will now be described and illustrated.

Figure 7B:
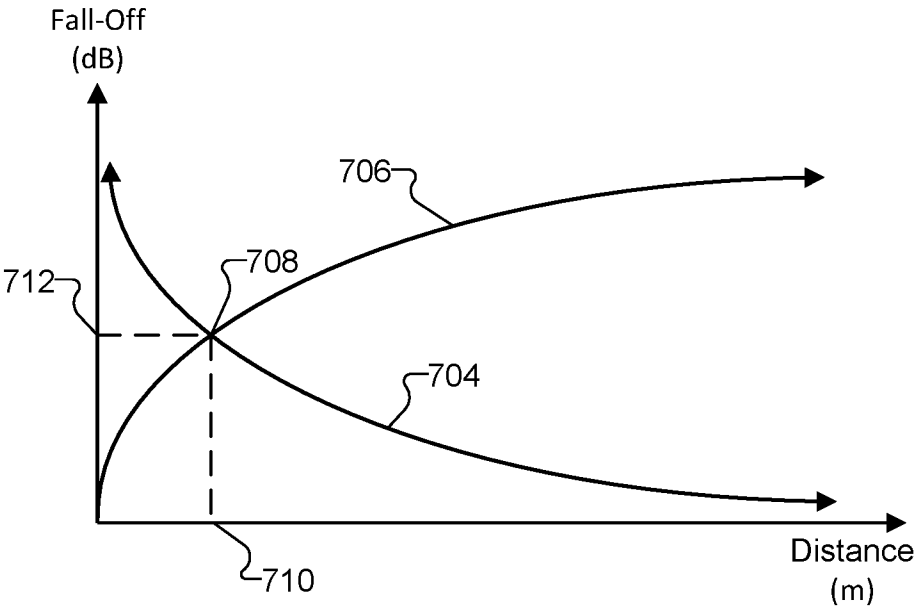
FIGS. 7A and 7B illustrate exemplary aspects of the magnitude compensation operation of FIG. 4 according to principles described herein.
Figure 7A:
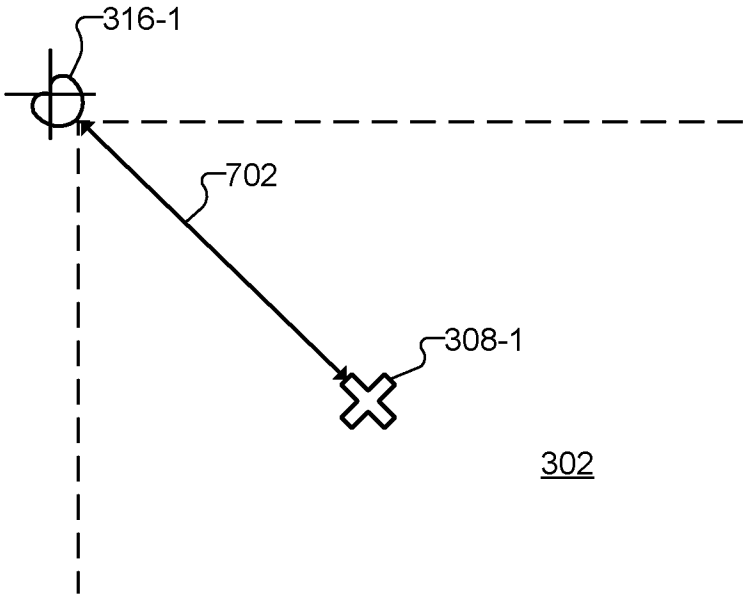

FIGS. 7A and 7B illustrate exemplary aspects of magnitude compensation operation 408. Specifically, FIG. 7A illustrates a portion of capture zone 302 including arbitrary location 308-1 at which a simulated microphone capture is to be generated. As shown, location 308-1 is a distance 702 from microphone 316-1. Distance 702 may be determined in any of the ways described herein and may be the same distance described above in relation to FIGS. 6A and 6B. Magnitude compensation operation 408 may be performed based on an assumption that the one or more sound sources are at least as far from microphone 316-1 as is location 308-1 and that, as a result, the magnitude of sound that would be captured at location 308-1 is greater than the magnitude of sound that is actually captured at microphone 316-1. For instance, as described above in relation to projecting phase 606, location 308-1 and the locations of one or more sound sources may be assumed to be in the near field with respect to one another in some examples. Due to this assumption, and in like manner as phase compensation operation 406 described above, it will be understood that magnitude compensation operation 408 may result in an accurate simulation of the magnitude that would be captured at location 308-1 when the assumption holds true, but may not simulate an exact value in examples where location 308-1 is in the far field with respect to the locations of the one or more sound sources. Thus, as described above, it may be desirable to simulate more precise magnitude values by taking into account the locations of sound sources, particularly in examples where location 308-1 is in the far field with respect to the one or more sound sources.

Sound intensity is known to fall off in accordance with the inverse-square law, or, in other words, to be inversely proportional to the square of the distance from the sound source. Accordingly, as shown in FIG. 7B, in order to adjust magnitude values for the audio signal captured by microphone 316-1, a magnitude fall-off curve 704 based on the inverse-square law may be used. However, because the projected magnitude being determined by magnitude compensation operation 408 is to simulate the magnitude at location 308-1 prior to the magnitude falling off to the level actually captured by microphone 316-1, an inverse magnitude fall-off curve 706 may be employed to determine how much each particular magnitude associated with each frequency bin in magnitude component 504 is to be amplified to simulate what a microphone would capture at location 308-1. For example, inverse magnitude fall-off curve 706 may have an inverse shape as magnitude fall-off curve 704 and may intersect magnitude fall-off curve 704 at a reference point 708 associated with a measured magnitude at a known distance 710. Specifically, as shown, both curves 704 and 706 may be calibrated to indicate a magnitude fall off 712 at known distance 710. Then, once inverse magnitude fall-off curve 706 is properly calibrated to the capture zone, each magnitude value in magnitude component 504 may be scaled by a distance scalar obtained from the value of inverse magnitude fall-off curve 706 at distance 702.

Returning to FIG. 4, once phase and magnitude compensation operations 406 and 408 have been performed in the frequency domain, signal reconstruction operation 410 may be performed to transform the modified frequency-domain audio signals generated by operations 406 and 408 back into the time domain. To this end, signal reconstruction operation 410 may perform inverse operations to those described above for plane wave decomposition operation 404. Specifically, for example, signal reconstruction operation 410 may convert polar coordinates (e.g., for respective magnitude and phase values) into complex cartesian coordinates, and then use an inverse frequency-domain transform technique (e.g., an inverse FFT technique) to transform the frequency-domain audio signals back to the time domain. As described above in relation to plane wave decomposition operation 404, in some examples (e.g., when signals are being processed in real time) signal reconstruction operation 410 may be facilitated by an overlap-add technique which may be performed after the inverse frequency-domain transform technique to minimize or eliminate undesirable artifacts of the conversion process.

Back in the time domain, the simulated set of audio signals transformed by signal reconstruction operation 410 may essentially represent a simulation of an A-format signal that would be captured by a full-sphere multi-capsule microphone (e.g., a first order or higher order Ambisonic microphone) at the location within the capture zone. However, because the phase and magnitude compensations are projected from inward-looking directional microphones 316 rather than, for instance, outward-looking directional capsules of an actual full-sphere multi-capsule microphone, the phase of each of the time-domain audio signals may be inverted. To remedy this issue, phase inversion operation 412 may be performed to invert the simulated audio signals.

Additionally, time alignment operation 414 may be performed on each of these signals based on the respective distance of each microphone 316 from the identified location 308. Directional microphones 316 distributed around capture zone 302 may each capture sounds with slightly different timings than would the respective capsules of the full-sphere multi-capsule microphone being simulated at the identified location 308. Accordingly, time alignment operation 414 may introduce different delays into each of the audio signals in the simulated set of audio signals to simulate each signal being captured simultaneously at a coincident point at the identified location 308.

At this point, the simulated set of audio signals generated by signal reconstruction operation 410 and modified by operations 412 and 414 may represent a simulated set of audio signals representative of a simulation of a full-sphere multi-capsule microphone capture at the identified location 308. For example, the simulated set of audio signals may represent the simulation of the A-format signal that would be captured by the full-sphere multi-capsule microphone at the location 308 within the capture zone. However, for this A-format signal to be used (e.g., rendered for a user as part of a virtual reality experience), the A-format signal may be converted into a renderable set of audio signals such as a B-format signal. In other words, in certain examples, a simulated set of audio signals representative of a simulation of the full-sphere multi-capsule microphone capture may collectively constitute an A-format signal representative of the full-sphere multi-capsule microphone capture, while a renderable set of audio signals may collectively constitute a B-format signal configured to be rendered to simulate the full-sphere sound for the virtual location.

Figure 8B:
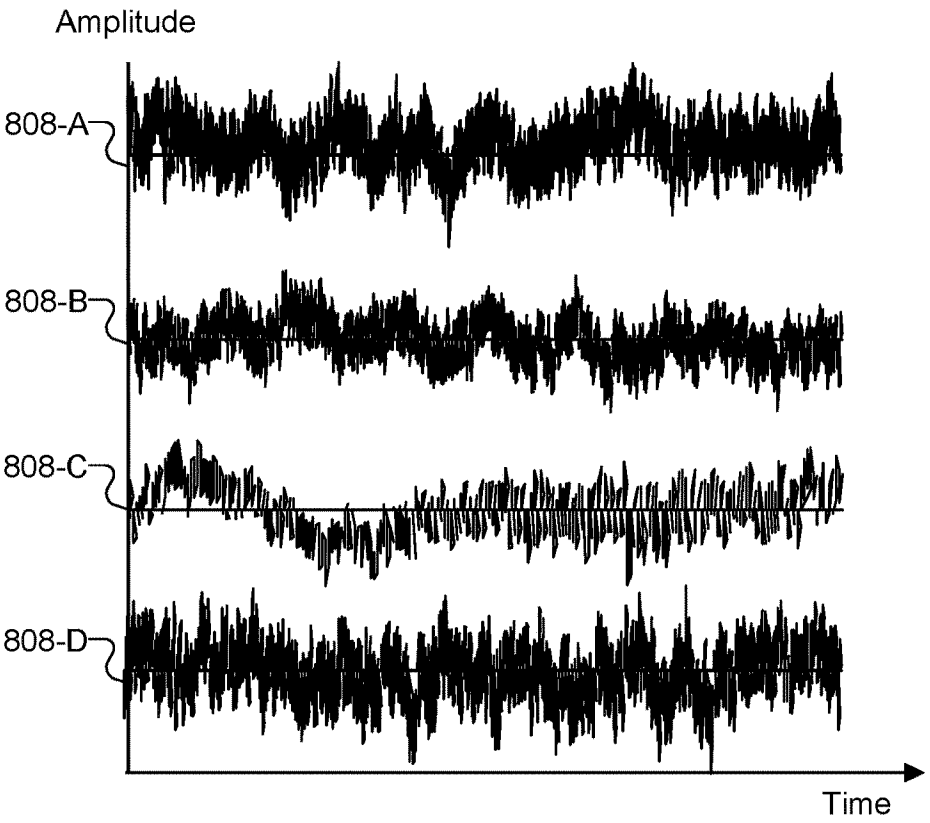
FIGS. 8A and 8B illustrate exemplary aspects of an A-format signal implementation of a simulated set of audio signals representative of a simulation of a full-sphere multi-capsule microphone capture according to principles described herein.
Figure 8A:
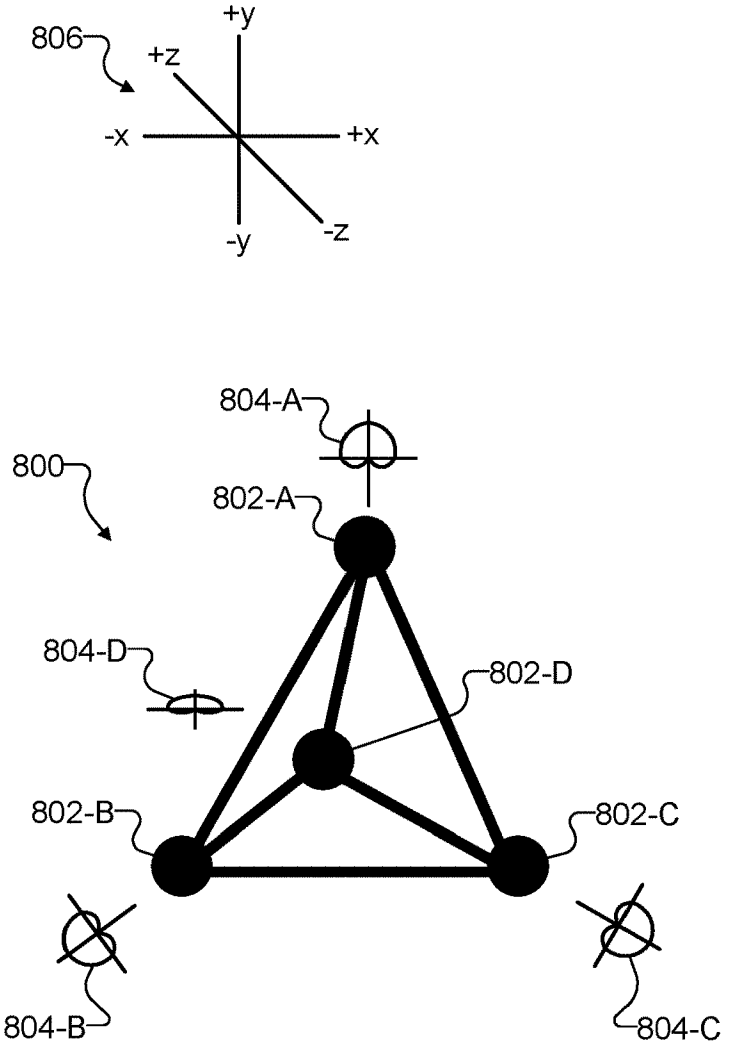

To illustrate, FIGS. 8A and 8B show exemplary aspects of an A-format signal implementation of a simulated set of audio signals representative of a simulation of a full-sphere multi-capsule microphone capture, while FIGS. 9A and 9B illustrate exemplary aspects of a B-format signal implementation of a renderable set of audio signals configured to be rendered to simulate full-sphere sound for a virtual location.

In particular, FIG. 8A shows a structural diagram illustrating exemplary directional capture patterns of full-sphere multi-capsule microphone 800 (e.g., a first-order Ambisonic microphone whose signal capture from the identified location is being simulated by the simulated set of audio signals). FIG. 8A shows that full-sphere multi-capsule microphone 800 includes four directional capsules 802 (i.e., capsules 802-A through 802-D) in a tetrahedral arrangement. Next to each capsule 802, a small polar pattern 804 (i.e., polar patterns 804-A through 804-D, respectively) is shown to illustrate the directionality with which capsules 802 each capture incoming sound. Additionally, a coordinate system 806 associated with full-sphere multi-capsule microphone 800 is also shown. It will be understood that, in some examples, each capsule 802 may be centered on a side of a tetrahedron shape, rather than disposed at a corner of the tetrahedron as shown in FIG. 8A.

As shown in FIG. 8A, each polar pattern 804 of each capsule 802 is directed or pointed so that the capsule 802 captures more sound in a direction radially outward from a center of the tetrahedral structure of full-sphere multi-capsule microphone 800 than in any other direction. For example, as shown, each of polar patterns 804 may be cardioid polar patterns such that capsules 802 effectively capture sounds originating in the direction the respective polar patterns are pointed while effectively ignoring sounds originating in other directions. Because capsules 802 point away from the center of the tetrahedron, no more than one of capsules 802 may point directly along a coordinate axis (e.g., the x-axis, y-axis, or z-axis) of coordinate system 806 while the other capsules 802 point along other vectors that do not directly align with the coordinate axes. As such, while audio signals captured by each capsule 802 may collectively contain sufficient information to implement a 3D surround sound signal, it may be convenient or necessary to first convert the signal captured by full-sphere multi-capsule microphone 800 (i.e., the audio signals captured by each of capsules 802) to a format that aligns with a 3D cartesian coordinate system such as coordinate system 806.

FIG. 8B illustrates a simulated set of audio signals 808 (e.g., audio signals 808-A through 808-D) simulated to correspond to different capsules 802 (e.g., corresponding to what capsules 802-A through 802-D, respectively, would capture at the location 308) of full-sphere multi-capsule microphone 800. Collectively, this set of four audio signals 808 generated by the four directional capsules 802 may constitute what is known as an "A-format" signal. As such, the simulated set of audio signals 808 may also be referred to herein as "A-format signal 808".

As mentioned above, an A-format signal may include sufficient information to implement 3D surround sound, but it may be desirable to convert the A-format signal from a format that may be specific to a particular microphone configuration to a more universal format that facilitates the decoding of the full-sphere 3D sound into renderable audio signals to be played back by specific speakers (e.g., a renderable stereo signal, a renderable surround sound signal such as a 5.1 surround sound signal, etc.). This may be accomplished by converting the A-format signal to a B-format signal. Referring back to FIG. 4, such a conversion may be performed as part of A-format to B-format conversion operation 416. For instance, in a first order Ambisonic implementation such as described herein, converting the A-format signal to a B-format signal may further facilitate rendering of the audio by aligning the audio signals to a 3D cartesian coordinate system such as coordinate system 806.

To illustrate aspects of the B-format signal generated by operation 416, FIG. 9A shows additional directional capture patterns associated with full-sphere multi-capsule microphone 800 (i.e., the microphone being simulated at the identified location 308 within the capture zone) along with coordinate system 806, similar to FIG. 8A. In particular, in place of polar patterns 804 that are directly associated with simulated audio signals that would be captured by each capsule 802, FIG. 9A illustrates a plurality of polar patterns 902 (i.e., polar patterns 902-*w*, 902-*x*, 902-*y*, and 902-*z*) that are associated with the coordinate axes of coordinate system 806. Specifically, polar pattern 902-*w* is a spherical polar pattern that describes an omnidirectional signal representative of overall sound pressure captured from all directions, polar pattern 902-*x* is a figure-8 polar pattern that describes a directional audio signal representative of sound originating along the x-axis of coordinate system 806 (i.e., either from the +x direction or the −x direction), polar pattern 902-*y* is a figure-8 polar pattern that describes a directional audio signal representative of sound originating along the y-axis of coordinate system 806 (i.e., either from the +y direction or the −y direction), and polar pattern 902-*z* is a figure-8 polar pattern that describes a directional audio signal representative of sound originating along the z-axis of coordinate system 806 (i.e., either from the +z direction or the −z direction).

FIG. 9B illustrates a set of audio signals 904 (e.g., audio signals 904-*w* through 904-*z*) that are derived from the set of audio signals 808 illustrated in FIG. 8B and that collectively compose a first-order B-format signal. Audio signals 904 may implement or otherwise be associated with the directional capture patterns of polar patterns 902. Specifically, audio signal 904-*w* may be an omnidirectional audio signal implementing polar pattern 902-*w*, while audio signals 904-*x* through 904-*z* may each be figure-8 audio signals implementing polar patterns 902-*x* through 902-*z*, respectively. Collectively, this set of four audio signals 904 derived from audio signals 808 to align with coordinate system 806 may be known as an "B-format" signal. As such, the set of audio signals 904 may also be referred to herein as "B-format signal 904."

B-format signals such as B-format signal 904 may be advantageous in applications where sound directionality matters such as in virtual reality media content or other surround sound applications. This is because the audio coordinate system to which the audio signals are aligned (e.g., coordinate system 806) may be oriented to associate with (e.g., align with, tie to, etc.) a video coordinate system to which visual aspects of a virtual world (e.g., a virtual reality world) are aligned. As such, a B-format signal may be decoded and rendered for a particular user so that sounds seem to originate from the direction that it appears to the user that the sounds should be coming from. Even as the user turns around within the virtual world to thereby realign himself or herself with respect to the video and audio coordinate systems, the sound directionality may properly shift and rotate around the user just as the video content shifts to show new parts of the virtual world the user is looking at.

In the example of FIGS. 9A and 9B, B-format signal 904 is derived from A-format signal 808 simulated for tetrahedral full-sphere multi-capsule microphone 800. Such a configuration may be referred to as a first-order Ambisonic microphone and may allow signals 904 of the B-format signal to approximate the directional sound along each respective coordinate axis with a good deal of accuracy and precision. However, as mentioned above, it may be desirable in certain examples to achieve an even higher degree of accuracy and precision with respect to the directionality of a B-format signal such as B-format signal 904. In such examples, full-sphere multi-capsule microphone 800 may include more than four capsules 802 that are spatially distributed in an arrangement associated with an Ambisonic microphone having a higher order than a first-order Ambisonic microphone (e.g., a second-order Ambisonic microphone, a third-order Ambisonic microphone, etc.). Rather than a tetrahedral arrangement, the more than four capsules 802 in such examples may be arranged in other geometric patterns having more than four corners, and may be configured to generate more than four audio signals to be included in an A-format signal from which a B-format signal may be derived.

In this way, the higher-order Ambisonic microphone may provide an increased level of directional resolution, precision, and accuracy for the location-confined B-format signal that is derived. It will be understood that above the first-order (i.e., four-capsule tetrahedral) full-sphere multi-capsule microphone 800 illustrated in FIGS. 8A and 9A, it may not be possible to simulate Ambisonic components directly with single microphone capsules (e.g., capsules 802). Instead, higher-order spherical harmonics components may be derived from various spatially distributed (e.g., directional or omnidirectional) capsules using advanced digital signal processing techniques.

Returning to FIG. 4, once an A-format signal such as A-format signal 808 has been converted to a B-format signal such as B-format signal 904 (e.g., by way of A-format to B-format conversion operation 416), the B-format signal may be further processed and prepared in various ways before being provided to and rendered by a media player device. For example, as shown, system 100 may perform a post filtering operation 418 on the B-format signal to filter spurious high order artifacts that may be introduced during the generation and earlier processing of the B-format signal.

Additionally, the processing of the simulated set of audio signals to form the renderable set of audio signals may include mixing one or more of additional audio signals 422 together with the renderable set of audio signals (e.g., the post-filtered B-format signal). For example, additional audio signal mixing operation 420 may be performed by combining additional audio signals 422 into the B-format signal. Additional audio signals 422 may be representative of sound that is not captured by the plurality of directional microphones disposed at the plurality of locations on the perimeter of the capture zone of the real-world scene (e.g. directional microphones 316). For instance, additional audio signals 422 may include voice-over content, announcer or narration content, social chat content (e.g., from other users experiencing the same virtual reality space at the same time), Foley content or other sound effects, and so forth.

Once the B-format signal has been filtered and mixed with other suitable sounds in operations 418 and 420, dataflow 400 shows that the B-format signal may be decoded in signal decoding operation 424. Specifically, system 100 may decode the B-format signal to a particular speaker configuration associated with the media player device upon which the B-format signal is to be rendered. The B-format signal may be decoded to any suitable speaker configuration such as a stereo configuration, a surround sound configuration (e.g., a 5.1 configuration, etc.), or the like.

Finally, once the B-format signal has been processed in any of the ways described above or any other suitable manner, the B-format signal may be considered a renderable set of audio signals that is configured to be rendered by a media player device such as media player device 210. Accordingly, the renderable set of audio signals may be provided (e.g., by way of network 208) to the media player device and rendered (i.e., played back, presented, etc.) for the user as part of a dynamic and immersive virtual reality experience. This is illustrated in dataflow 400 by signal rendering operation 426.

Figure 10:
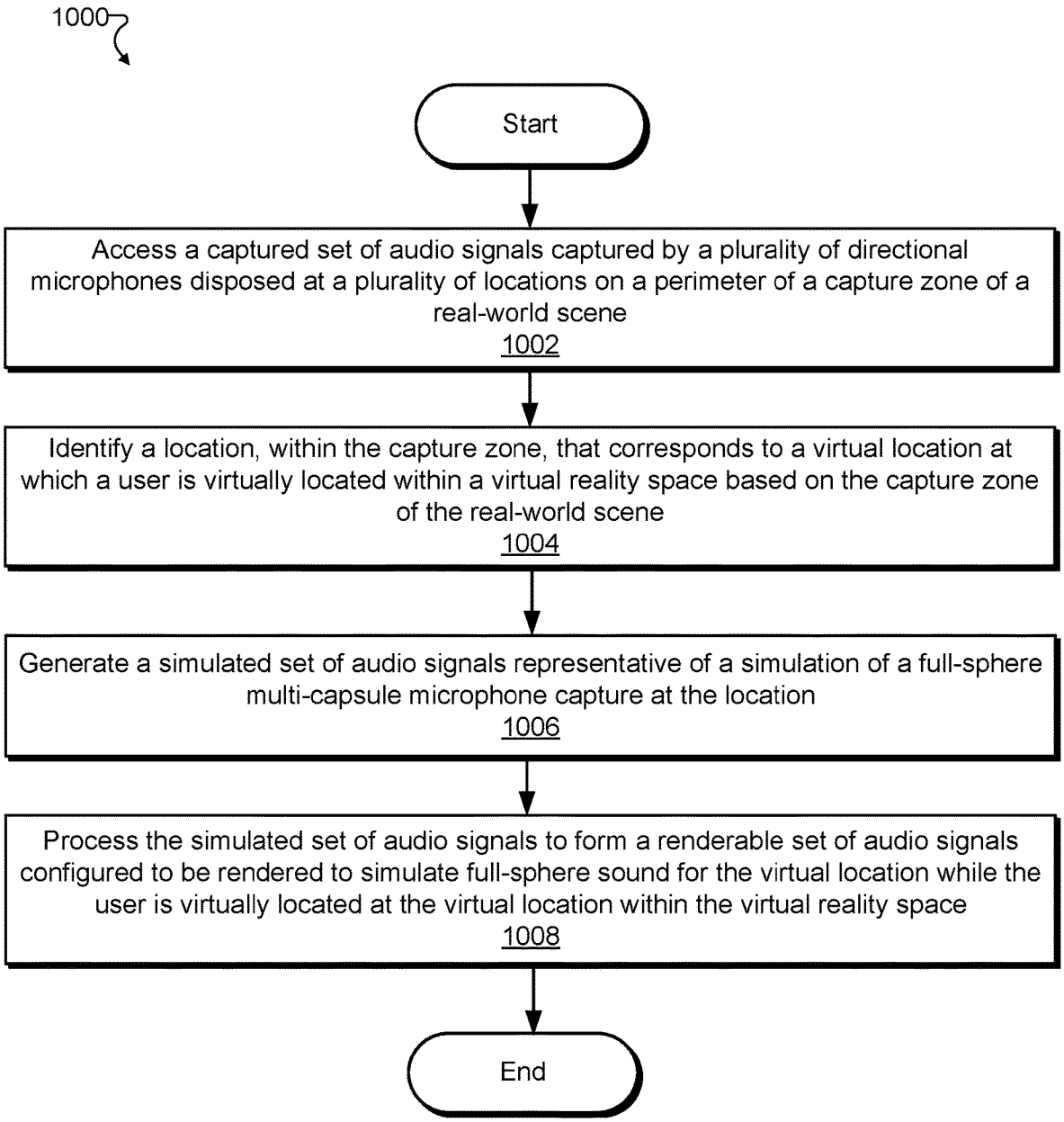
FIGS. 10 and 11 illustrate exemplary methods for simulating microphone capture within a capture zone of a real-world scene according to principles described herein.

FIG. 10 illustrates an exemplary method 1000 for simulating microphone capture within a capture zone of a real-world scene. While FIG. 10 illustrates exemplary operations according to one embodiment, other embodiments may omit, add to, reorder, and/or modify any of the operations shown in FIG. 10. One or more of the operations shown in FIG. 10 may be performed by system 100, any components included therein, and/or any implementation thereof.

In operation 1002, a microphone capture simulation system may access a captured set of audio signals. For example, the captured set of audio signals may be captured by a plurality of directional microphones disposed at a plurality of locations on a perimeter of a capture zone of a real-world scene, and the microphone capture simulation system may access the captured set of audio signals from the plurality of directional microphones. Operation 1002 may be performed in any of the ways described herein.

In operation 1004, the microphone capture simulation system may identify a location within the capture zone. For example, the location may correspond to a virtual location at which a user is virtually located within a virtual reality space that is being experienced by the user and is based on the capture zone of the real-world scene. Operation 1004 may be performed in any of the ways described herein.

In operation 1006, the microphone capture simulation system may generate a simulated set of audio signals representative of a simulation of a full-sphere multi-capsule microphone capture at the location at which the user is virtually located. For example, the microphone capture simulation system may generate the simulated set of audio signals based on the captured set of audio signals accessed in operation 1002 and the location identified in operation 1004. Operation 1006 may be performed in any of the ways described herein.

In operation 1008, the microphone capture simulation system may process the simulated set of audio signals to form a renderable set of audio signals. For instance, the renderable set of audio signals may be configured to be rendered by a media player device used by the user. In some examples, when rendered by the media player device, the renderable set of audio signals may simulate full-sphere sound for the virtual location identified in operation 1004 while the user is virtually located at the virtual location within the virtual reality space. Operation 1008 may be performed in any of the ways described herein.

Figure 11:
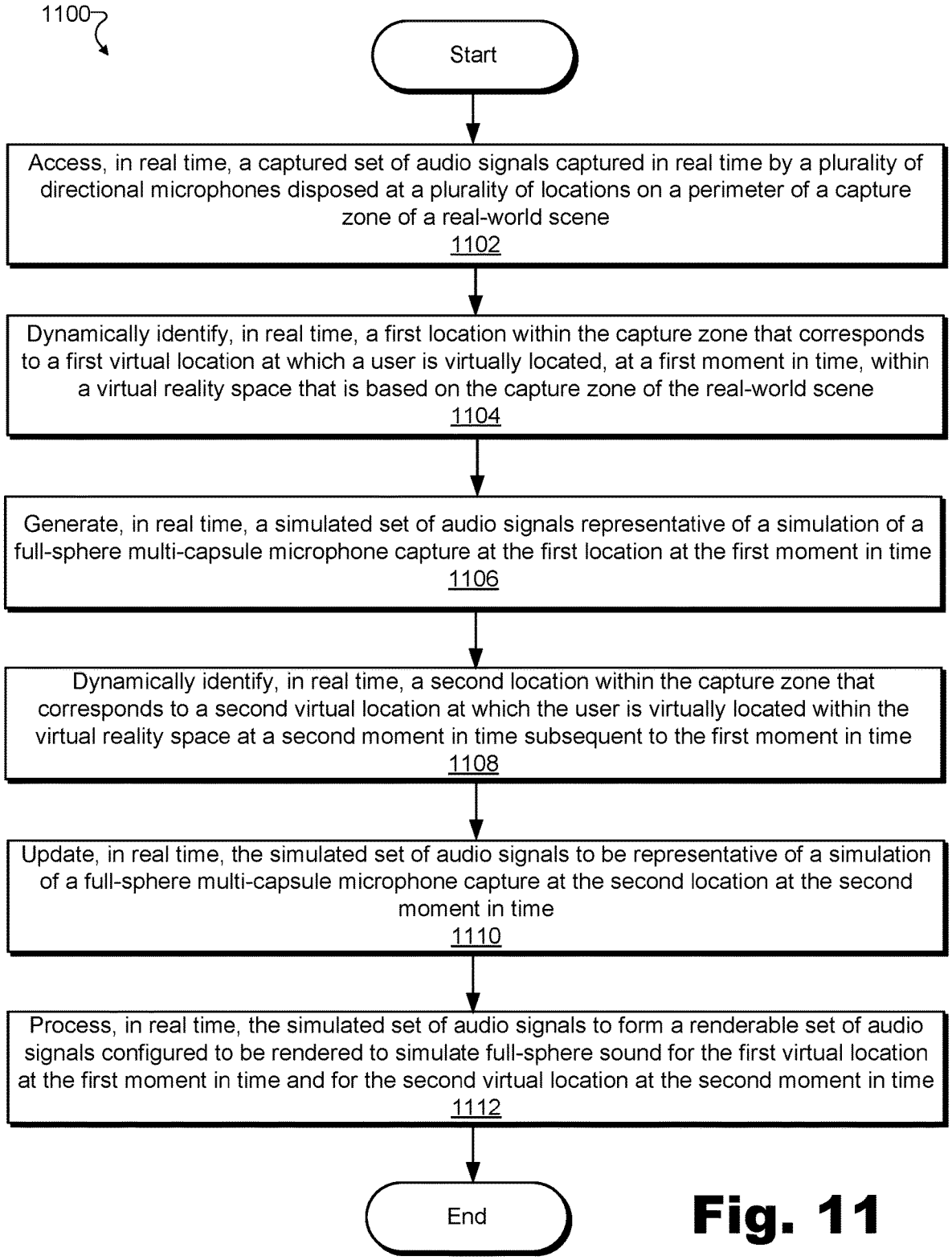

FIG. 11 illustrates an additional exemplary method 1100 for simulating microphone capture within a capture zone of a real-world scene. While FIG. 11 illustrates exemplary operations according to one embodiment, other embodiments may omit, add to, reorder, and/or modify any of the operations shown in FIG. 11. One or more of the operations shown in FIG. 11 may be performed by system 100, any components included therein, and/or any implementation thereof.

In operation 1102, a microphone capture simulation system may access a captured set of audio signals. The captured set of audio signals may be captured in real time by a plurality of directional microphones disposed at a plurality of locations on a perimeter of a capture zone of a real-world scene. In some examples, the microphone capture simulation system may access the captured set of audio signals in real time from the plurality of directional microphones. Operation 1102 may be performed in any of the ways described herein.

In operation 1104, the microphone capture simulation system may identify a first location within the capture zone. The first location may correspond to a first virtual location at which a user is virtually located within a virtual reality space that is being experienced by the user at a first moment in time and that is based on the capture zone of the real-world scene. In some examples, the microphone capture simulation system may dynamically identify the first location in real time. Operation 1104 may be performed in any of the ways described herein.

In operation 1106, the microphone capture simulation system may generate a simulated set of audio signals. The simulated set of audio signals may be representative of a simulation of a full-sphere multi-capsule microphone capture at the first location at the first moment in time. In some examples, the microphone capture simulation system may generate the simulated set of audio signals in real time based on the captured set of audio signals accessed in operation 1102 and the first location identified in operation 1104. Operation 1106 may be performed in any of the ways described herein.

In operation 1108, the microphone capture simulation system may identify a second location within the capture zone. The second location may correspond to a second virtual location at which the user is virtually located within the virtual reality space at a second moment in time subsequent to the first moment in time. In some examples, the microphone capture simulation system may dynamically identify the second location in real time. Operation 1108 may be performed in any of the ways described herein.

In operation 1110, the microphone capture simulation system may update the simulated set of audio signals. For instance, the microphone capture simulation system may update the simulated set of audio signals to be representative of a simulation of a full-sphere multi-capsule microphone capture at the second location at the second moment in time. In some examples, the microphone capture simulation system may update the simulated set of audio signals in real time based on the captured set of audio signals accessed in operation 1002 and the second location identified in operation 1108. Operation 1110 may be performed in any of the ways described herein.

In operation 1112, the microphone capture simulation system may process the simulated set of audio signals to form a renderable set of audio signals. For example, the renderable set of audio signals may be configured to be rendered by a media player device used by the user. When rendered by the media player device, the renderable set of audio signals may simulate full-sphere sound for the first virtual location at the first moment in time and for the second virtual location at the second moment in time. In some examples, the microphone capture simulation system may process the simulated set of audio signals to form the renderable set of audio signals in real time. Operation 1112 may be performed in any of the ways described herein.

In certain embodiments, one or more of the systems, components, and/or processes described herein may be implemented and/or performed by one or more appropriately configured computing devices. To this end, one or more of the systems and/or components described above may include or be implemented by any computer hardware and/or computer-implemented instructions (e.g., software) embodied on at least one non-transitory computer-readable medium configured to perform one or more of the processes described herein. In particular, system components may be implemented on one physical computing device or may be implemented on more than one physical computing device. Accordingly, system components may include any number of computing devices, and may employ any of a number of computer operating systems.

In certain embodiments, one or more of the processes described herein may be implemented at least in part as instructions embodied in a non-transitory computer-readable medium and executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored and/or transmitted using any of a variety of known computer-readable media.

A computer-readable medium (also referred to as a processor-readable medium) includes any non-transitory medium that participates in providing data (e.g., instructions) that may be read by a computer (e.g., by a processor of a computer). Such a medium may take many forms, including, but not limited to, non-volatile media, and/or volatile media. Non-volatile media may include, for example, optical or magnetic disks and other persistent memory. Volatile media may include, for example, dynamic random access memory ("DRAM"), which typically constitutes a main memory. Common forms of computer-readable media include, for example, a disk, hard disk, magnetic tape, any other magnetic medium, a compact disc read-only memory ("CD-ROM"), a digital video disc ("DVD"), any other optical medium, random access memory ("RAM"), programmable read-only memory ("PROM"), electrically erasable programmable read-only memory ("EPROM"), FLASH-EEPROM, any other memory chip or cartridge, or any other tangible medium from which a computer can read.

Figure 12:
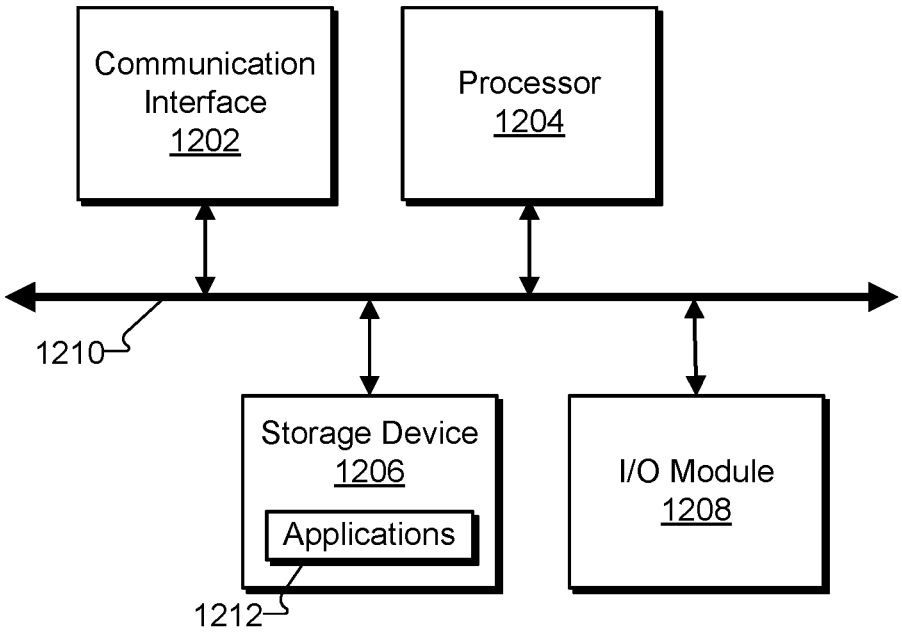
FIG. 12 illustrates an exemplary computing device according to principles described herein.

FIG. 12 illustrates an exemplary computing device 1200 that may be specifically configured to perform one or more of the processes described herein. As shown in FIG. 12, computing device 1300 may include a communication interface 1202, a processor 1204, a storage device 1206, and an input/output ("I/O") module 1208 communicatively connected via a communication infrastructure 1210. While an exemplary computing device 1200 is shown in FIG. 12, the components illustrated in FIG. 12 are not intended to be limiting. Additional or alternative components may be used in other embodiments. Components of computing device 1200 shown in FIG. 12 will now be described in additional detail.

Communication interface 1202 may be configured to communicate with one or more computing devices. Examples of communication interface 1202 include, without limitation, a wired network interface (such as a network interface card), a wireless network interface (such as a wireless network interface card), a modem, an audio/video connection, and any other suitable interface.

Processor 1204 generally represents any type or form of processing unit capable of processing data or interpreting, executing, and/or directing execution of one or more of the instructions, processes, and/or operations described herein. Processor 1204 may direct execution of operations in accordance with one or more applications 1212 or other computer-executable instructions such as may be stored in storage device 1206 or another computer-readable medium.

Storage device 1206 may include one or more data storage media, devices, or configurations and may employ any type, form, and combination of data storage media and/or device. For example, storage device 1206 may include, but is not limited to, a hard drive, network drive, flash drive, magnetic disc, optical disc, RAM, dynamic RAM, other non-volatile and/or volatile data storage units, or a combination or sub-combination thereof. Electronic data, including data described herein, may be temporarily and/or permanently stored in storage device 1206. For example, data representative of one or more executable applications 1212 configured to direct processor 1204 to perform any of the operations described herein may be stored within storage device 1206. In some examples, data may be arranged in one or more databases residing within storage device 1206.

I/O module 1208 may include one or more I/O modules configured to receive user input and provide user output. One or more I/O modules may be used to receive input for a single virtual reality experience. I/O module 1208 may include any hardware, firmware, software, or combination thereof supportive of input and output capabilities. For example, I/O module 1208 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1208 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1208 is configured to provide graphical data to a display for presentation to a user. The graphical data may be representative of one or more graphical user interfaces and/or any other graphical content as may serve a particular implementation.

In some examples, any of the facilities described herein may be implemented by or within one or more components of computing device 1200. For example, one or more applications 1212 residing within storage device 1206 may be configured to direct processor 1204 to perform one or more processes or functions associated with facilities 102 or 104 of system 100. Likewise, storage facility 106 of system 100 may be implemented by or within storage device 1206.

To the extent the aforementioned embodiments collect, store, and/or employ personal information provided by individuals, it should be understood that such information shall be used in accordance with all applicable laws concerning protection of personal information. Additionally, the collection, storage, and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

accessing, by a microphone capture simulation system from a plurality of directional microphones disposed at a plurality of locations on a perimeter of a capture zone of a real-world scene, a captured set of audio signals captured by the plurality of directional microphones;

receiving, by the microphone capture simulation system from a media player device used by a user to experience a virtual reality space that is based on the capture zone of the real-world scene, continuously updated information regarding a virtual location at which the user is virtually located within the virtual reality space, the virtual location tracked by the media player device as the user changes the virtual location while experiencing the virtual reality space;

generating, by the microphone capture simulation system based on the captured set of audio signals and the continuously updated information regarding the virtual location, a simulated set of audio signals representative of a simulation of a full-sphere multi-capsule microphone capture at the virtual location, wherein the simulated set of audio signals includes audio signals representative of simulated microphone capture for four simulated directional capsules directed radially outward from a center of a tetrahedral structure at the virtual location, a directionality of at least one of the four simulated directional capsules is unaligned with any axis of a cartesian coordinate system having three orthogonal axes, and the simulated set of audio signals is continuously updated to be representative of the simulation of the full-sphere multi-capsule microphone captured at the virtual location as the user changes the virtual location while experiencing the virtual reality space; and processing, by the microphone capture simulation system, the simulated set of audio signals to form a renderable set of audio signals configured to be rendered, by the media player device, to simulate full-sphere sound for the changing virtual location of the user as the user experiences the virtual reality space, wherein the renderable set of audio signals includes three audio signals having directionality that is aligned, respectively, with the three orthogonal axes of the coordinate system, and a fourth audio signal representative of simulated microphone capture for a simulated omnidirectional capsule at the location.

2. The method of claim 1, wherein the generating of the simulated set of audio signals representative of the simulation of the full-sphere multi-capsule microphone capture at the virtual location includes performing, for each audio signal in the captured set of audio signals, a plane wave decomposition operation, a phase compensation operation, a magnitude compensation operation, and a phase inversion operation.

3. The method of claim 2, wherein:

the microphone capture simulation system generates a set of frequency-domain audio signals as a result of performing the plane wave decomposition operation;

the phase compensation operation is performed with respect to the set of frequency-domain audio signals generated as the result of performing the plane wave decomposition operation; and the phase compensation operation includes determining, for each frequency represented in each of the frequency-domain audio signals in the set of frequency-domain audio signals, a projected phase associated with the virtual location based on a measured phase for the frequency represented in the frequency-domain audio signal.

4. The method of claim 2, wherein:

the microphone capture simulation system generates a set of frequency-domain audio signals as a result of performing the plane wave decomposition operation;

the magnitude compensation operation is performed with respect to the set of frequency-domain audio signals generated as the result of performing the plane wave decomposition operation; and the magnitude compensation operation includes determining, for each frequency represented in each of the frequency-domain audio signals in the set of frequency-domain audio signals, a projected magnitude associated with the virtual location based on a measured magnitude for the frequency represented in the frequency-domain audio signal.

5. The method of claim 2, wherein the plane wave decomposition operation includes:

transforming each of the audio signals in the capture set of audio signals into a respective frequency-domain audio signal by way of a fast Fourier transform technique; and converting complex values included within each of the respective frequency-domain audio signals from a Cartesian form to a polar form.

6. The method of claim 1, wherein:

the simulated set of audio signals representative of the simulation of the full-sphere multi-capsule microphone capture collectively constitute an A-format signal representative of the full-sphere multi-capsule microphone capture;

the renderable set of audio signals collectively constitute a B-format signal configured to be rendered to simulate the full-sphere sound for the virtual location; and the processing of the simulated set of audio signals to form the renderable set of audio signals includes performing an A-format to B-format conversion operation to convert the A-format signal to the B-format signal, performing a post filtering operation on the B-format signal to filter content associated with high order artifacts, and decoding the B-format signal to a particular speaker configuration associated with the media player device upon which the B-format signal is to be rendered.

7. The method of claim 1, wherein the processing of the simulated set of audio signals to form the renderable set of audio signals includes mixing an additional audio signal together with the renderable set of audio signals, the additional audio signal representative of sound that is not captured by the plurality of directional microphones disposed at the plurality of locations on the perimeter of the capture zone of the real-world scene.

8. The method of claim 1, wherein a directional microphone within the plurality of directional microphones is implemented as a uniform linear array microphone that includes a plurality of omnidirectional microphones disposed at different locations with respect to the capture zone of the real-world scene.

9. The method of claim 1, further comprising:

identifying, by the microphone capture simulation system, a virtual sound source location within the capture zone at which sound represented within the captured set of audio signals originates;

wherein the generating of the simulated set of audio signals representative of the simulation of the full-sphere multi-capsule microphone capture at the virtual location is further based on the virtual sound source location.

10. The method of claim 1, embodied as computer-executable instructions on at least one non-transitory computer-readable medium.

11. A method comprising:

accessing, in real time by a microphone capture simulation system from a plurality of directional microphones disposed at a plurality of locations on a perimeter of a capture zone of a real-world scene, a captured set of audio signals captured in real time by the plurality of directional microphones;

receiving, in real time by the microphone capture simulation system from a media player device used by a user to experience a virtual reality space that is based on the capture zone of the real-world space, a first virtual location at which the user is virtually located within the virtual reality space, the first virtual location identified by the media player device as the user experiences the virtual reality space at a first moment in time;

generating, in real time by the microphone capture simulation system based on the captured set of audio signals and the first virtual location, a simulated set of audio signals representative of a simulation of a full-sphere multi-capsule microphone capture at the first virtual location at the first moment in time, wherein the simulated set of audio signals includes audio signals representative of simulated microphone capture for four simulated directional capsules directed radially outward from a center of a tetrahedral structure at the first virtual location, and a directionality of at least one of the four simulated directional capsules is unaligned with any axis of a cartesian coordinate system having three orthogonal axes;

receiving, in real time by the microphone capture simulation system from the media player device, a second virtual location at which the user is virtually located within the virtual reality space, the second virtual location identified by the media player device as the user experiences the virtual reality space at a second moment in time subsequent to the first moment in time;

updating, in real time by the microphone capture simulation system based on the captured set of audio signals and the second virtual location, the simulated set of audio signals to be representative of a simulation of a full-sphere multi-capsule microphone capture at the second virtual location at the second moment in time; and processing, in real time by the microphone capture simulation system, the simulated set of audio signals to form a renderable set of audio signals configured to be rendered, by the media player device, to simulate full-sphere sound for the first virtual location at the first moment in time and for the second virtual location at the second moment in time, wherein the renderable set of audio signals includes three audio signals having directionality that is aligned, respectively, with the three orthogonal axes of the coordinate system, and a fourth audio signal representative of simulated microphone capture for a simulated omnidirectional capsule at the location.

12. The method of claim 11, embodied as computer-executable instructions on at least one non-transitory computer-readable medium.

13. A system comprising:

at least one physical computing device that:

accesses, from a plurality of directional microphones disposed at a plurality of locations on a perimeter of a capture zone of a real-world scene, a captured set of audio signals captured by the plurality of directional microphones;

receives, from a media player device used by a user to experience a virtual reality space that is based on the capture zone of the real-world scene, continuously updated information regarding a virtual location at which the user is virtually located within the virtual reality space, the virtual location tracked by the media player device as the user changes the virtual location while experiencing the virtual reality space;

generates, based on the captured set of audio signals and the continuously updated information regarding the virtual location, a simulated set of audio signals representative of a simulation of a full-sphere multi-capsule microphone capture at the virtual location, wherein the simulated set of audio signals includes audio signals representative of simulated microphone capture for four simulated directional capsules directed radially outward from a center of a tetrahedral structure at the virtual location, a directionality of at least one of the four simulated directional capsules is unaligned with any axis of a cartesian coordinate system having three orthogonal axes, and the simulated set of audio signals is continuously updated to be representative of the simulation of the full-sphere multi-capsule microphone captured at the virtual location as the user changes the virtual location while experiencing the virtual reality space; and processes the simulated set of audio signals to form a renderable set of audio signals configured to be rendered, by the media player device, to simulate full-sphere sound for the changing virtual location of the user as the user experiences the virtual reality space, wherein the renderable set of audio signals includes three audio signals having directionality that is aligned, respectively, with the three orthogonal axes of the coordinate system, and a fourth audio signal representative of simulated microphone capture for a simulated omnidirectional capsule at the location.

14. The system of claim 13, wherein the at least one physical computing device generates the simulated set of audio signals representative of the simulation of the full-sphere multi-capsule microphone capture at the virtual location by performing, for each audio signal in the captured set of audio signals, a plane wave decomposition operation, a phase compensation operation, a magnitude compensation operation, and a phase inversion operation.

15. The system of claim 14, wherein:

the at least one physical computing device generates a set of frequency-domain audio signals as a result of performing the plane wave decomposition operation;

the phase compensation operation is performed with respect to the set of frequency-domain audio signals generated as the result of performing the plane wave decomposition operation; and the phase compensation operation includes determining, for each frequency represented in each of the frequency-domain audio signals in the set of frequency-domain audio signals, a projected phase associated with the virtual location based on a measured phase for the frequency represented in the frequency-domain audio signal.

16. The system of claim 14, wherein:

the at least one physical computing device generates a set of frequency-domain audio signals as a result of performing the plane wave decomposition operation;

the magnitude compensation operation is performed with respect to the set of frequency-domain audio signals generated as the result of performing the plane wave decomposition operation; and the magnitude compensation operation includes determining, for each frequency represented in each of the frequency-domain audio signals in the set of frequency-domain audio signals, a projected magnitude associated with the virtual location based on a measured magnitude for the frequency represented in the frequency-domain audio signal.

17. The system of claim 13, wherein:

the simulated set of audio signals representative of the simulation of the full-sphere multi-capsule microphone capture collectively constitute an A-format signal representative of the full-sphere multi-capsule microphone capture;

the renderable set of audio signals collectively constitute a B-format signal configured to be rendered to simulate the full-sphere sound for the virtual location; and the at least one physical computing device processes the simulated set of audio signals to form the renderable set of audio signals by performing an A-format to B-format conversion operation to convert the A-format signal to the B-format signal, performing a post filtering operation on the B-format signal to filter content associated with high order artifacts, and decoding the B-format signal to a particular speaker configuration associated with the media player device upon which the B-format signal is to be rendered.

18. The system of claim 13, wherein the at least one physical computing device processes the simulated set of audio signals to form the renderable set of audio signals by performing operations including mixing an additional audio signal together with the renderable set of audio signals, the additional audio signal representative of sound that is not captured by the plurality of directional microphones disposed at the plurality of locations on the perimeter of the capture zone of the real-world scene.

19. The system of claim 13, wherein a directional microphone within the plurality of directional microphones is implemented as a uniform linear array microphone that includes a plurality of omnidirectional microphones disposed at different locations with respect to the capture zone of the real-world scene.

20. The system of claim 13, wherein:

the at least one physical computing device further identifies a virtual sound source location within the capture zone at which sound represented within the captured set of audio signals originates; and the generation of the simulated set of audio signals representative of the simulation of the full-sphere multi-capsule microphone capture at the virtual location is further based on the virtual sound source location.

* * * * *